US007796926B2

(12) United States Patent
Matsuda et al.

(10) Patent No.: US 7,796,926 B2
(45) Date of Patent: Sep. 14, 2010

(54) DEVELOPING APPARATUS AND ELECTROPHOTOGRAPHIC IMAGE-FORMING APPARATUS

(75) Inventors: Takuma Matsuda, Suntou-gun (JP); Masayoshi Shimamura, Yokohama (JP); Yasutaka Akashi, Yokohama (JP); Satoshi Otake, Numazu (JP); Minoru Ito, Susono (JP); Kazuhito Wakabayashi, Mishima (JP); Daisuke Yoshiba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/486,273

(22) Filed: Jun. 17, 2009

(65) Prior Publication Data

US 2009/0257788 A1 Oct. 15, 2009

Related U.S. Application Data

(63) Continuation of application No. PCT/JP2009/052254, filed on Feb. 4, 2009.

(30) Foreign Application Priority Data

Feb. 19, 2008 (JP) ..... 2008-037419

(51) Int. Cl.
*G03G 15/08* (2006.01)

(52) U.S. Cl. ..... 399/286; 399/282; 399/284; 399/274; 430/123.3; 430/123.41; 430/106.1; 430/106.2; 430/105

(58) Field of Classification Search ..... 399/274, 399/282, 284, 252, 279, 277, 276, 280, 286, 399/285; 430/123.3, 123.41, 106.1, 106.2, 430/105

See application file for complete search history.

(56) References Cited

U.S. PATENT DOCUMENTS

| | | | | |
|---|---|---|---|---|
| 7,361,442 | B2 | 4/2008 | Otake et al. | 430/122.5 |
| 2007/0036968 | A1 | 2/2007 | Shimamura et al. | 428/323 |

FOREIGN PATENT DOCUMENTS

| | | |
|---|---|---|
| JP | 2003-323042 | 11/2003 |
| JP | 2005-077870 | 3/2005 |
| JP | 2005-099703 | 4/2005 |
| JP | 2005-134750 | 5/2005 |
| JP | 2005-157318 | 6/2005 |
| JP | 2006-276714 | 10/2006 |
| JP | 2007-206647 | 8/2007 |

*Primary Examiner*—David P Porta
*Assistant Examiner*—Bryan P Ready
(74) *Attorney, Agent, or Firm*—Fitzpatrick, Cella, Harper & Scinto

(57) ABSTRACT

A developing apparatus is provided which can suppress a fluctuation in image density in a discontinuous printing mode provided with a pause period. The developing apparatus includes a developer for developing an electrostatic latent image on a photosensitive drum, a developer bearing member for carrying and conveying the developer and a developer layer thickness-regulating unit placed close to the developer bearing member for regulating the amount of the developer carried and conveyed by the developer bearing member, the developer layer thickness-regulating unit being. As the developer, a negatively chargeable, one-component, magnetic toner is used having magnetic toner particles containing a binder resin and a magnetic iron oxide particle, and has a specific saturation magnetization, specific weight-average particle diameter and specific composition. The developer bearing member includes a surface layer containing a binder resin, a quaternary ammonium salt, graphitized particles, and conductive, spherical resin particles, and has a specific surface shape.

7 Claims, 5 Drawing Sheets

DEVELOPING APPARATUS AND ELECTROPHOTOGRAPHIC IMAGE-FORMING APPARATUS

This application is a continuation of International Application No. PCT/JP2009/052254, filed on Feb. 4, 2009, which claims the benefit of Japanese Patent Application No. 2008-037419 filed on Feb. 19, 2008.

BACKGROUND OF THE INVENTION

1. Field of the Invention

The present invention relates to a developing apparatus to be used for developing an electrostatic latent image formed on an electrostatic latent image-bearing member such as a photosensitive member or an electrostatic recording derivative, and an electrophotographic image-forming apparatus including the developing apparatus.

2. Description of the Related Art

Electrophotography generally involves the utilization of a photoconductive substance, and includes: forming an electrostatic latent image on an electrostatic latent image-bearing member (photosensitive drum) by various means; applying a developing bias to a developing zone; developing the electrostatic latent image with a developer to form a toner image; transferring the toner image onto a transfer material such as paper as required; and fixing the toner image on the transfer material with heat or pressure to provide a copy. Developing methods in the electrophotography are mainly classified into a one-component developing method in which there is no need for a carrier and a two-component developing method involving the use of a carrier. A developing apparatus employing the one-component developing method is advantageous in that since no carrier is needed, the frequency at which toner must be exchanged owing to deterioration in the toner can be reduced; in addition, there is no need to provide the developing apparatus with, for example, a mechanism for adjusting the concentration of the toner or carrier, so the developing apparatus itself can be reduced in size and weight.

Japanese Patent Application Laid-Open No. 2005-157318 discloses that the particle size of a developer (toner) is reduced and the saturation magnetization of the developer is reduced in order that the image quality of a copy may be higher.

However, when the amount of a magnetic material is reduced and the particle size of a developer is reduced, a so-called charge-up phenomenon as described below is apt to occur: the developer is brought into a passive state by mirror image force with the surface of a developing sleeve, so a latent image on a photosensitive drum is difficult to develop with the developer from the developing sleeve. As a result, a reduction in image density may occur.

To deal with the charge-up of a developer, Japanese Patent Application Laid-Open No. 2003-323042 proposes a developer bearing member having a resin layer which is incorporated with graphitized particles having a degree of graphitization p(002) of 0.20 to 0.95 and an indentation hardness HUT[68] of 15 to 60 are incorporated. The charge-up of the developer is alleviated by the effect of the graphitized particles of enhancing the performance of rapidly and stably charging the developer.

However, according to investigation made by the inventors of the present invention, when electrophotographic images are formed from a one-component, magnetic toner having a small particle diameter and a small saturation magnetization according to a predetermined printing mode, the following phenomenon occurs: an image density after rest largely fluctuates as compared with that before the pause as shown in FIG. 6. The term "predetermined printing mode" as used herein refers to the following printing condition: after 1,000 or more sheets are continuously printed, a pause period of 30 minutes to 2 hours is set, and then 1,000 or more sheets are printed again. The inventors have found that, when electrophotographic images are formed according to the printing mode, an image density on the first sheet after the rest is extremely higher than an image density before the pause. In addition, the inventors have found that an image density gradually returns to the image density before the pause by continuously performing image formation after the pause.

SUMMARY OF THE INVENTION

In view of the foregoing, the present invention is directed to provide a developing apparatus capable of suppressing such an irregular fluctuation in image density as described above, and an electrophotographic image-forming apparatus including the developing apparatus.

The inventors of the present invention have made investigation into the above-mentioned increase of image density occurring after a pause. As a result, the inventors have found the correlation between the increase and the charge-up of a developer. That is, the inventors have considered as follows: mirror force affecting the developer which has undergone charge-up owing to extensive operation is weakened by setting a pause period, and an image can be easily developed with the developer at the time of printing after a pause, whereby an image density increases.

The inventors of the present invention have conducted investigation on the basis of the above consideration. As a result, the inventors have found that a combination of a specific developer and a developer bearing member having a specific surface shape is effective in solving the above problems.

According to one aspect of the present invention, there is provided a developing apparatus comprising at least; a developer for developing an electrostatic latent image formed on a photosensitive drum, a developer bearing member for bearing and conveying the developer, and a developer layer thickness-regulating unit placed close to the developer bearing member so as to regulate an amount of the developer borne and conveyed by the developer bearing member, wherein; the developer is a negatively chargeable, one-component, magnetic toner, and comprises magnetic toner particles each comprising at least a binder resin and magnetic iron oxide particle, the developer has a saturation magnetization of 20 $Am^2/kg$ or more and 40 $Am^2/kg$ or less in a magnetic field of 795.8 kA/m, and has a weight-average particle diameter ($D_4$) of 4.0 μm or more and 8.0 μm or less, wherein a ratio X of an amount of Fe(2+) to a total amount of Fe in the magnetic iron oxide particle is 34% or more and 50% or less, the total amount of Fe being an amount of Fe element when the magnetic iron oxide particle is dissolved so that an Fe element-dissolving ratio reaches 10 mass %, the developer bearing member comprises at least a substrate, a resin layer as a surface layer formed on the substrate, and a magnetic member provided in the substrate, and the resin layer has the developer triboelectrically-charged negatively, and contains a binder resin having in its structure at least one selected from the group consisting of a —$NH_2$ group, a =NH group, and a —NH— bond, a quaternary ammonium salt for reducing a property of imparting negative triboelectric charges to the developer, graphitized particles each having a degree of graphitization p(002) of 0.22 or more and 0.75 or less, and conductive, spherical carbon particles having a volume-average particle diameter of 4.0 μm to 8.0 μm as particles for providing a surface of the resin layer with irregularities, wherein, when a square region of 0.50 mm in side on the surface of the developer bearing member is equally divided with 725 straight lines which are parallel to one side of the square region, and other 725 straight lines intersecting therewith at right angle, the whole area of the developer bearing member on which the developer is borne has a plurality of independent protrusions whose heights exceeds $D_4/4$ with reference to an average (H) of three-dimensional heights measured at intersections of the 725 straight liens and the other 725 straight lines, wherein the sum of areas of the protrusions at a height of $D_4/4$ is 5% or more and 30% or less of the region, arithmetic average roughness Ra(A) determined from only the protrusions is 0.25 μm or more and 0.55 μm or less, and arithmetic average roughness Ra(B) determined from area other than the protrusions is 0.65 μm or more and 1.20 μm or less.

In addition, the electrophotographic image-forming apparatus according to the present invention is characterized by including the above developing apparatus.

As described above, according to the present invention, a fluctuation in image density can be suppressed even in a discontinuous printing mode provided with a pause period.

Further features of the present invention will become apparent from the following description of exemplary embodiments with reference to the attached drawings.

DESCRIPTION OF THE EMBODIMENTS

Figure 6:
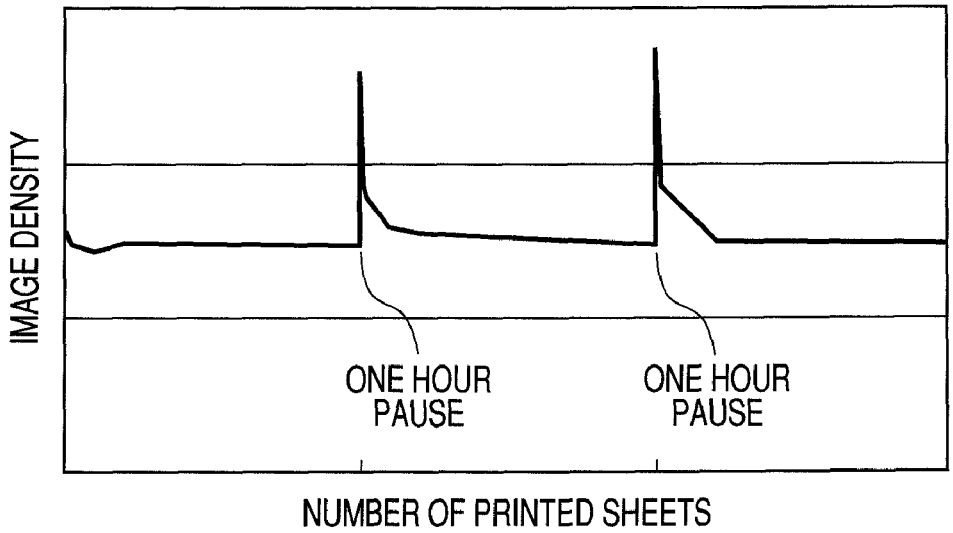
FIG. 6 is an explanatory view for a change in image density in a discontinuous printing mode provided with a pause period.
Figure 7:
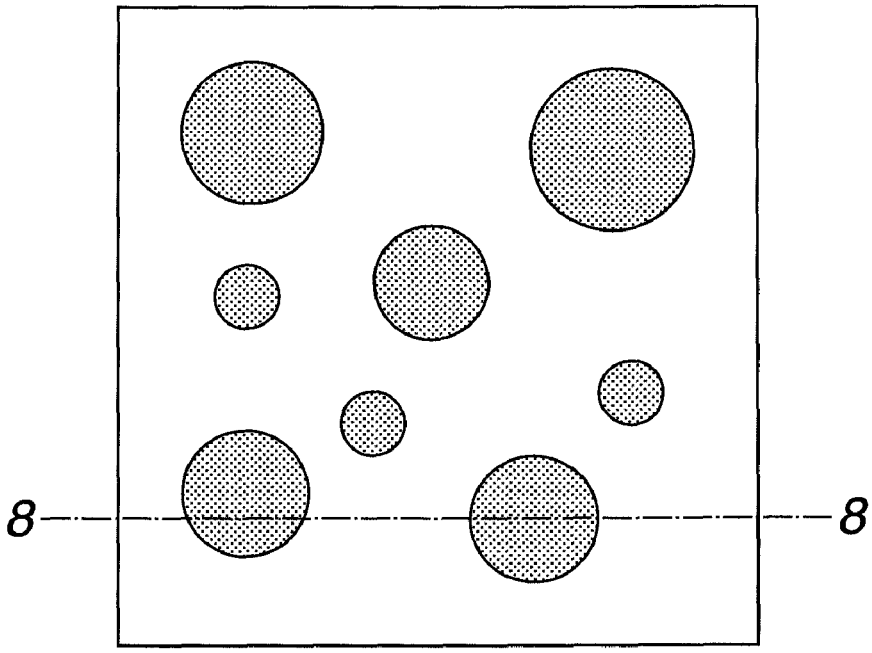
FIG. 7 is a plan view schematically showing a cut surface at a height of $[H+(D_4/4)]$ in a unit area of the surface of the resin layer of a developer bearing member according to the present invention.
Figure 8:
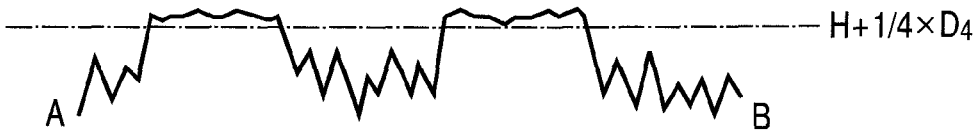
FIG. 8 is a sectional view schematically showing the cut surface along the line 8-8 in FIG. 7.

The inventors of the present invention have conducted investigations into a discontinuous printing mode provided with a pause period. As a result, the inventors have found that, when a pause period of 30 minutes to 2 hours is provided after continuous printing of 1,000 or more sheets, a difference in image density is liable to occur between before and after the pause. As shown in FIG. 6, the density difference in this case is such a phenomenon that image density at the time point when continuous printing is restarted after a pause is higher than image density before the pause, and image density returns to the image density before the pause by continuous printing of about 1,000 sheets.

The present inventors have made an investigation into the electrical characteristics of a developer, and the component and surface shape of a developer bearing member with the view of suppressing the fluctuation of image density after a pause as compared with image density before the pause.

Keeping the triboelectric charge quantity of a developer constant is effective in suppressing a fluctuation in image density. In other words, the following approaches are effective: the triboelectric charging of the developer is quickly performed, and excessive triboelectric charging is suppressed.

In view of the foregoing, the inventors of the present invention have conducted extensive investigations while paying attention to components for the magnetic iron oxide particles of a developer and a developer bearing member, and a relationship between the particle diameter of the developer and the surface shape of the developer bearing member. As a result, the inventors have found that a developing apparatus in which a specific developer and a specific developer bearing member are combined can suppress the above fluctuation in image density better. Hereinafter, the present invention will be described in detail by way of a preferred embodiment.

Figure 1:
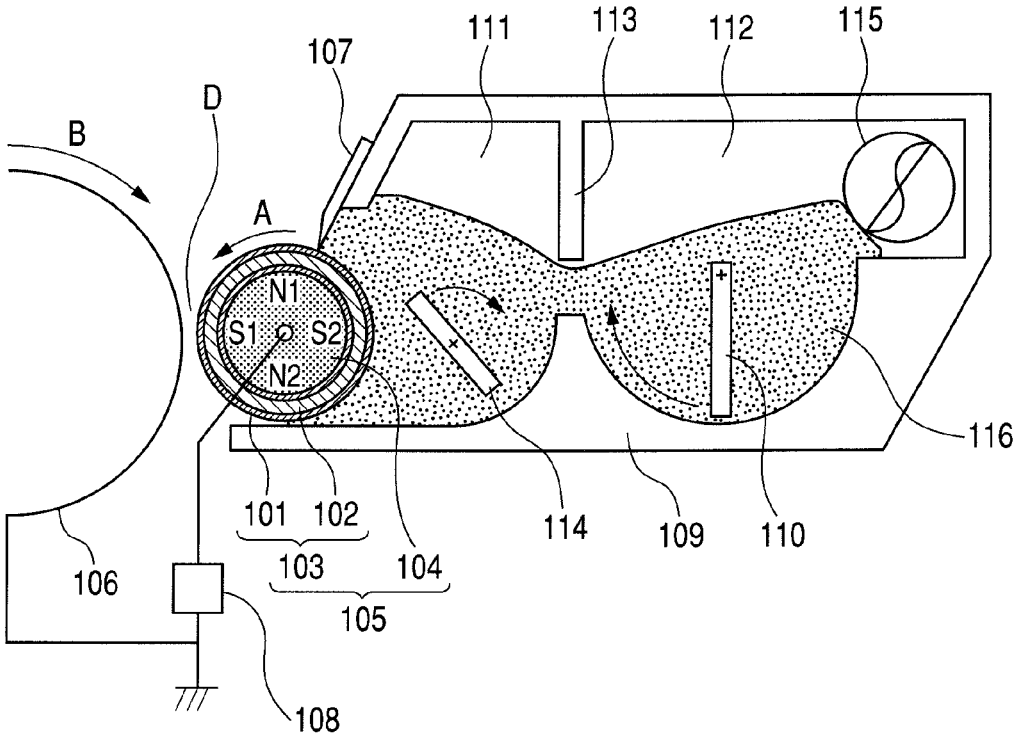
FIG. 1 is a schematic view showing an embodiment of a developing apparatus of the present invention.

First, explanation will be made with reference to FIG. 1 showing the outline section of a developing apparatus according to the present invention. The developing apparatus according to the present invention includes:

a developer 116;

a container (developer container) 109 storing the developer;

a developer bearing member 105 for carrying the developer and for conveying the developer to a developing zone D; and a developer layer thickness-regulating member (magnetic blade) 107 for regulating the amount of the developer carried and conveyed by the developer bearing member, the developer layer thickness-regulating member being placed close to the developer bearing member.

In addition, the developing apparatus forms a toner image through the following procedure: while a developer layer is formed on the developer bearing member 105 by the magnetic blade 107, the developer on the developer bearing member 105 is conveyed to the developing zone D opposite to an electrostatic latent image-bearing member 106, and then an electrostatic latent image on the electrostatic latent image-bearing member 106 is developed with the conveyed developer.

<Developer>

The developer is a negatively chargeable, one-component, magnetic toner having magnetic toner particles containing a binder resin and a magnetic iron oxide particle, and satisfying the following requirements (A1) to (A3):

(A1) a saturation magnetization in a magnetic field of 795.8 kA/m is 20 $Am^2/kg$ or more and 40 $Am^2/kg$ or less;

(A2) a weight-average particle diameter ($D_4$) is 4.0 μm or more and 8.0 μm or less; and (A3) a ratio X of the amount of Fe(2+) to the total amount of Fe of the magnetic iron oxide particles dissolved until an Fe element dissolution ratio reaches 10 mass % is 34% or more and 50% or less.

<<Requirement (A1)>>

When the saturation magnetization exceeds 40 $Am^2/kg$, the magnetic iron oxide particles must be added in a relatively large amount, so an image is apt to be developed with a larger amount of the developer than necessary owing to magnetic cohesiveness between the toner particles, and image defects such as scattering are apt to occur. On the other hand, when the saturation magnetization is less than 20 $Am^2/kg$, magnetic binding force by the magnetic member weakens, so the reduction and destabilization of conveying force of the developer bearing member tend to occur, and image defects such as scattering are apt to occur.

<<Requirement (A2)>>

The negatively chargeable, one-component, magnetic toner according to the present invention has a weight-average particle diameter ($D_4$) of 4.0 μm or more and 8.0 μm or less. When the weight-average particle diameter ($D_4$) is less than 4.0 μm, the amount of a magnetic powder in one toner particle is relatively reduced, so the effect of using the magnetic iron oxide particles becomes less. In addition, the surface area of the toner particles increases, so the developer is apt to undergo charge-up at the time of continuous printing. Accordingly, the weight-average particle diameter ($D_4$) of less than 4.0 μm is disadvantageous to the suppression of the fluctuation of image density after a pause as compared with image density before the pause. On the other hand, when the weight-average particle diameter ($D_4$) exceeds 8.0 μm, the surface area of the toner particles is reduced, so the charge quantity of the developer is apt to be insufficient. Accordingly, the weight-average particle diameter ($D_4$) in excess of 8.0 μm is disadvantageous to the suppression of a fluctuation or reduction in image density.

<<Requirement (A3)>>

With regard to the requirement (A3), the Fe element dissolution ratio is an indicator showing the extent to which the magnetic iron oxide particles are dissolved when the dissolution starts from their surfaces. A state in which the Fe element dissolution ratio is 0 mass % is a state in which none of the magnetic iron oxide particles is dissolved.

A state in which the Fe element dissolution ratio is 10 mass % is a state in which the surfaces of the magnetic iron oxide particles are dissolved so that 90 mass % of Fe may remain with respect to the total amount of Fe of the magnetic iron oxide particles. Therefore, the phrase "total amount of Fe dissolved until the Fe element dissolution ratio reaches 10 mass %" refers to the total amount of Fe present in the dissolved regions of the magnetic iron oxide particles. In addition, the ratio X is a ratio of the amount of Fe(2+) to the total amount of Fe.

Additionally, a state in which the Fe element dissolution ratio is 100 mass % is a state in which the magnetic iron oxide particles are completely dissolved.

When the ratio X is less than 34%, the developer is apt to undergo charge-up at the time of continuous duration, so the fluctuation of image density after a pause as compared with image density before the pause is apt to occur. When the ratio X exceeds 50%, the magnetic iron oxide particles are susceptible to oxidation, so a fluctuation in image density is apt to occur as in the case of the foregoing.

In addition, in the magnetic iron oxide particles, a ratio (X/Y) of X to Y, where X and Y are defined as below, is preferably more than 1.00 and 1.30 or less: X represents a ratio of the amount of Fe(2+) to the total amount of Fe dissolved when the Fe element dissolution ratio is 10 mass % with respect to the total amount of Fe (hereinafter referred to also as "surface Fe(2+)"); and Y represents a ratio of the amount of Fe(2+) to the total amount of Fe in the remaining 90 mass % (hereinafter referred to also as "internal Fe(2+)").

The ratio X/Y represents an abundance ratio between Fe(2+) on the surfaces of the magnetic iron oxide particles and Fe(2+) in the magnetic iron oxide particles. When the ratio X/Y exceeds 1.00, the amount of Fe(2+) on the surfaces of the magnetic iron oxide particles is larger than that in the magnetic iron oxide particles, so the effect of suppressing the charge-up of the developer becomes higher. In addition, when the ratio X/Y is 1.30 or less, the amount of Fe(2+) in the magnetic iron oxide particles also becomes suitable, so a balance of the amounts of Fe(2+) is not largely lost, and the triboelectric chargeability can easily become stable.

Although the reason why the above effects can be obtained by using a developer having magnetic iron oxide particles with an increased amount of Fe(2+) on their surfaces has not been theoretically elucidated yet, the inventors of the present invention consider the reason as described below.

When magnetic iron oxide particles with the amount of Fe(2+) on their surfaces set to fall within the range specified in the present invention are used in a developer, the exchange of charges between Fe(2+) and Fe(3+) is efficiently performed near the surface of each magnetic iron oxide particle. As a result, charge transfer in each magnetic iron oxide particle becomes smooth, and the triboelectric chargeability of the developer probably becomes more stable. In addition, the developer and the developer bearing member used in the present invention can work synergistically to suppress a fluctuation in image density.

In addition, in order that the ratio X of the amount of surface Fe(2+) may be controlled to stably fall within the range of the present invention, it is preferable that a core particle is formed by incorporating a metal element into each magnetic iron oxide particle, and a coating layer containing various metal elements is formed on the surface of the core particle. Of all the metal elements, Above all, it is particularly preferable that since the triboelectric chargeability of the developer with the developer bearing member used in the present invention is stabilized, each magnetic iron oxide particle contains silicon therein, and on the surface of the magnetic iron oxide particle, a coating layer containing silicon and aluminum is formed.

The amount of silicon in the core particles in terms of a silicon element is preferably 0.20 mass % or more and 1.50 mass % or less, or more preferably 0.25 mass % or more and 1.00 mass % or less, with respect to the entirety of the magnetic iron oxide particles. The amount of silicon in the coating layers in terms of an Si element is preferably 0.05 mass % or more and 0.50 mass % or less with respect to the entirety of the magnetic iron oxide particles. Further, the amount of aluminum in the coating layers in terms of an aluminum element is preferably 0.05 mass % or more and 0.50 mass % or less, or more preferably 0.10 mass % or more and 0.25 mass % or less, with respect to the entirety of the magnetic iron oxide particles. By setting the contents of the metal elements within the above ranges, the triboelectric chargeability of the developer with the developer bearing member used in the present invention is apt to be stabilized. In addition, it is more preferable for the magnetic iron oxide particles used in the present invention to have octahedral shapes in terms of dispersibility in the magnetic toner particles and a black tint.

The magnetic iron oxide particles used in the present invention have an average primary particle diameter of preferably 0.10 μm or more and 0.30 μm or less, or more preferably 0.10 μm or more and 0.20 μm or less. By setting the average primary particle diameter of the magnetic iron oxide particles to 0.20 μm or less, a magnetic powder can be dispersed uniformly in the magnetic toner particles, and the effect of suppressing the charge-up of the developer can be enhanced. In addition, by setting the average primary particle diameter of the magnetic iron oxide particles to 0.10 μm or more, Fe(2+) is inhibited from being oxidized, and the amount of Fe(2+) can be stably controlled.

In addition, the magnetic iron oxide particles have a magnetization of preferably 86.0 $Am^2/kg$ or more, or more preferably 87.0 $Am^2/kg$ or more, in an external magnetic field of 795.8 kA/m. In this case, magnetic ears are particularly favorably formed on a developing sleeve, and hence good developability can be obtained.

The content of the magnetic iron oxide particles to be used is preferably 20 parts by mass or more and 150 parts by mass or less, or more preferably 50 parts by mass or more and 120 parts by mass or less, with respect to 100 parts by mass of the binder resin of the developer. By setting the content within the range, the saturation magnetization of the developer can be controlled to be desirable.

<<Production Method>>

A general method of producing magnetite particles can be employed as a method of producing the magnetic iron oxide particles used in the present invention. A particularly preferable production method will be specifically described below.

The magnetic iron oxide particles used in the present invention can be produced by oxidizing ferrous hydroxide slurry obtained by mixing and neutralizing an aqueous solution of a ferrous salt with an alkaline solution.

The ferrous salt to be utilized has only to be a water-soluble salt, and examples of the ferrous salt include ferrous sulfate and ferrous chloride. In addition, a water-soluble silicate (such as sodium silicate) is preferably added to and mixed in the ferrous salt so that the content of the water-soluble silicate in terms of a silicon element may be 0.20 mass % or more and 1.50 mass % or less with respect to the final total amount of the magnetic iron oxide particles.

Next, the resultant aqueous solution of the ferrous salt containing a silicon element is mixed and neutralized with the alkaline solution so that the ferrous hydroxide slurry can be produced. Here, an aqueous solution of an alkali metal hydroxide such as an aqueous solution of sodium hydroxide or an aqueous solution of potassium hydroxide can be used as the alkaline solution.

The amount of the alkaline solution at the time of producing the ferrous hydroxide slurry has only to be adjusted depending on a required shape of each magnetic iron oxide particle. To be specific, spherical particles are obtained when the amount is adjusted so that the pH of the ferrous hydroxide slurry may be less than 8.0. In addition, hexahedral particles are obtained when the amount is adjusted so that the pH is 8.0 or more and 9.5 or less; octahedral particles are obtained when the amount is adjusted so that the pH exceed 9.5. In view of the foregoing, the amount is appropriately adjusted.

In order that the iron oxide particles can be obtained from the ferrous hydroxide slurry thus obtained, an oxidation reaction is performed while an oxidizing gas, or preferably air, is blown into the slurry. During the blowing of the oxidizing gas, the temperature of the slurry is kept at preferably 60 to 100° C., or particularly preferably 80 to 95° C. by heating.

It is important that the oxidation reaction be controlled in order that the ratio X in the magnetic iron oxide particles may be controlled to fall within the range of the present invention. To be specific, it is preferable that the amount of the oxidizing gas to be blown is gradually reduced with the progress of the oxidation of ferrous hydroxide so that the amount of the gas to be blown at the final stage is small. Upon performing such multistage oxidation reaction as described above, it is possible to selectively increase the amount of Fe(2+) on the surfaces of the iron oxide particles. When air is used as the oxidizing gas, the amount of air to be blown is preferably controlled as described below for slurry containing 100 moles of an iron element. The amount of air to be blown is gradually reduced in the following ranges:

the amount is 10 to 80 liters/min, or preferably 10 to 50 liters/min until 50% of ferrous hydroxide are turned into an iron oxide;

the amount is 5 to 50 liters/min, or preferably 5 to 30 liters/min until more than 50% and 75% or less of ferrous hydroxide are turned into an iron oxide;

the amount is 1 to 30 liters/min, or preferably 2 to 20 liters/min until more than 75% and 90% or less of ferrous hydroxide are turned into an iron oxide; and the amount is 1 to 15 liters/min, or particularly 2 to 8 liters/min at the stage where more than 90% of ferrous hydroxide are turned into an iron oxide.

Next, an aqueous solution of sodium silicate and an aqueous solution of aluminum sulfate are simultaneously charged into the resultant slurry of the iron oxide particles, and the pH of the mixture is adjusted to 5 or more and 9 or less so that a coating layer containing silicon and aluminum may be formed on the surface of each particle. The resultant slurry of the magnetic iron oxide particles each having the coating layer is subjected to filtration, washing, drying, and pulverization treatment by ordinary methods so that magnetic iron oxide particles may be obtained. In addition, shear stress is preferably applied to the slurry at the time of the production of the magnetic iron oxide particles to loosen the magnetic iron oxide particles once with a view to improving the fine dispersibility of the magnetic iron oxide particles in the magnetic toner particles.

Next, the binder resin will be described. As the binder resin, the following compounds may be used: a styrene-type resin, a styrene-type copolymer resin, a polyester resin, a polyol resin, a polyvinyl chloride resin, a phenolic resin, a naturally-modified phenolic resin, a natural-resin-modified maleic resin, an acrylic resin, a methacrylic resin, polyvinyl acetate, a silicone resin, a polyurethane resin, a polyamide resin, a furan resin, an epoxy resin, a xylene resin, a polyvinyl butyral, a terpene resin, a coumarone-indene resin, and a petroleum-type resin. Of those, examples of preferably used resins include the styrene-type copolymer resin, the polyester resin, a mixture of a polyester resin and a styrene-type copolymer resin, or a hybrid resin obtained by partial reaction of a polyester resin and a styrene-type copolymer resin.

Examples of monomers constituting a polyester-type unit in the polyester resin or the hybrid resin include the following compounds.

Examples of an alcohol component include the following: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; and a bisphenol derivative represented by the following structural formula (1); and diols represented by the following structural formula (2).

Structural formula (1)

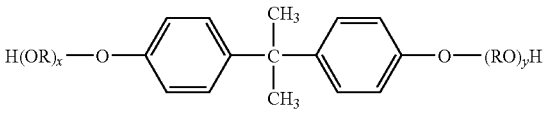

(In the structural formula (1), R represents an ethylene or propylene group, x and y each independently represent an integer of 1 or more, and the average of x+y is 2 to 10.)

Structural formula (2)

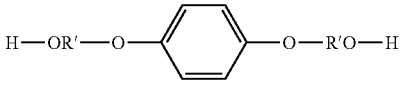

(In the formula, R' represents —$CH_2CH_2$—, $CH_2CH(CH_3)$, or $CH_2$—$C(CH_3)_2$.)

Examples of acid components include the following: benzene dicarboxylic acids, or anhydrides thereof such as phthalic acid, terephthalic acid, isophthalic acid, and phthalic anhydride; alkyldicarboxylic acids, or anhydrides thereof such as succinic acid, adipic acid, sebacic acid, and azelaic acid; succinic acids each substituted with an alkl group or an alkenyl group having 6 or more and less than 18 carbon atoms or anhydrides thereof; and unsaturated dicarboxylic acids such as fumaric acid, maleic acid, citraconic acid, and itaconic acid, or their anhydrides.

In addition, the polyester resin or the polyester-type unit preferably includes a crosslinking structure formed of a polyvalent carboxylic acid having 3 or more valencies or anhydrides thereof and/or a polyhydric alcohol having 3 or more valencies. Examples of the polyvalent carboxylic acid having 3 or more valencies or anhydrides thereof include 1,2,4-benzenetricarboxylic acid, 1,2,4-cyclohexanetricarboxylic acid, 1,2,4-naphthalenetricarboxylic acid, pyromellitic acid, and acid anhydrides thereof or lower alkyl esters thereof. Examples of the polyhydric alcohol having 3 or more valencies include 1,2,3-propanetriol, trimethylolpropane, hexanetriol, and pentaerythritol.

Of those, aromatic alcohols such as 1,2,4-benzenetricarboxylic acid and anhydrides thereof are particularly preferred because of superior friction stability against environmental fluctuation.

Examples of vinyl-type monomers constituting a styrene-type copolymer resin unit of the styrene-type copolymer resin or the hybrid resin include the following compounds.

Styrenes such as o-methylstyrene, m-methylstyrene, p-methylstyrene, p-methoxystyrene, p-phenylstyrene, p-chlorstyrene, 3,4-dichlorstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene, and derivatives thereof; styrene unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chlorethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalines; and acrylate or methacrylate derivatives such as acrylonitrile, methacrylonitrile, and acrylamide.

Further, the following may be exemplified: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated anhydrides such as crotonic anhydride and cinnamic anhydride; anhydrides of the above-mentioned α,β-unsaturated acids and lower aliphatic acids; and monomers each having a carboxyl group such as alkenylmalonic acid, alkenylglutaric acid, and alkenyladipic acid, and acid anhydrides thereof and monoesters thereof.

Further, examples of the monomers include: acrylic esters or mathacrylic esters such as 2-hydroxylethyl acrylate, 2-hydroxylethyl methacrylate, and 2-hydroxylpropyl methacrylate; and monomers each having a hydroxyl group such as 4-(1-hydroxy-1-methylbutyl)styrene and 4-(1-hydroxy-1-methylhexyl)styrene.

The styrene-type copolymer resin or the styrene-type copolymer resin unit may have a crosslinked structure in which crosslinkages are formed with a crosslinking agent having two or more vinyl groups. Examples of the crosslinking agent to be used in this case include: aromatic divinyl compounds (divinyl benzene and divinyl naphthalene); diacrylate compounds bonded by alkyl chains (ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylate of the above-mentioned compounds to methacrylate); diacrylate compounds bonded by alkyl chains each containing an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylate of the above-mentioned compounds to methacrylate); diacrylate compounds bonded by chains each containing an aromatic group and an ether bond [polyoxyethylene(2)-2,2-bis(4-hydroxyphenyl) propane diacrylate, polyoxyethylene(4)-2,2-bis(4-hydroxyphenyl)propane diacrylate, and those obtained by changing the acrylate of the above-mentioned compounds to methacrylate]; and polyester type diacrylate compounds ("MANDA" manufactured by Nippon Kayaku Co., Ltd.).

Examples of the polyfunctional crosslinking agent include the following: pentaerythritol triacrylate, trimethylolethane triacrylate, trimethylolpropane triacrylate, tetramethylolmethane tetraacrylate, oligoester acrylate, and those obtained by changing the acrylate of the above-mentioned compounds to methacrylate; triallyl cyanurate; and triallyl trimellitate.

Each of those crosslinking agents can be used in an amount of preferably 0.01 part by mass or more to 10 parts by mass or less, or more preferably 0.03 part by mass or more to 5 parts by mass or less, with respect to 100 parts by mass of the other monomer components. Of those crosslinking agents, examples of the crosslinking agents to be suitably used in the binder resin in terms of fixability and offset resistance include aromatic divinyl compounds (in particular, divinylbenzene) and diacrylate compounds bonded by chains each containing an aromatic group and an ether bond.

Examples of polymerization initiators that are used for polymerization for the styrene-type copolymer resin or for the styrene-type copolymer resin unit include the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

When a hybrid resin is used as a binder resin, a styrene-type copolymer resin component and/or a polyester resin component preferably contain(s) a monomer component capable of reacting with both resin components. A monomer capable of reacting with the styrene-type copolymer resin component among the monomers each forming the polyester resin component is, for example, an unsaturated dicarboxylic acid such as phthalic acid, maleic acid, citraconic acid, or itaconic acid, or an anhydride of the unsaturated dicarboxylic acid. A monomer capable of reacting with the polyester resin component among the monomers each forming the styrene-type copolymer resin component is, for example, a monomer having a carboxyl group or hydroxyl group, or an acrylate or methacrylate.

A method for the reaction of the styrene-type copolymer resin with the polyester resin is preferably a method involving performing the polymerization reaction of either or both the styrene-type copolymer resin and the polyester resin in the presence of a polymer containing any one of the above-mentioned monomer components each of which is capable of reacting with one of the resins.

A mass ratio between the polyester-type unit and the styrene-type copolymer unit in the hybrid resin is preferably 50/50 to 90/10, or more preferably 60/40 to 85/15. When the ratio between the polyester-type unit and the styrene-type copolymer unit falls within the above range, good triboelectric chargeability is apt to be obtained, and the storage stability of the developer and the dispersibility of a release agent are apt to become suitable.

In addition, in the GPC of tetrahydrofuran (THF) soluble matter of the binder resin, the weight-average molecular weight Mw is preferably 5,000 or more and 1,000,000 or less and the ratio Mw/Mn of the weight-average molecular weight Mw to the number-average molecular weight Mn is 1 or more and 50 or less, respectively, from the viewpoint of the fixability of the developer.

In addition, the binder resin has a glass transition temperature of preferably 45° C. or higher and 60° C. or lower, or more preferably 45° C. or higher and 58° C. or lower from the viewpoint of the fixability and storage stability of the developer.

In addition, such binder resins as described above can be used each singly. Alternatively, two kinds of resins having different softening points, that is, a high-softening point resin (H) and a low-softening point resin (L) may be used as a mixture having a mass ratio H/L in the range of 100/0 to 30/70, or preferably 100/0 to 40/60. The term "high-softening point resin" refers to a resin having a softening point of 100° C. or higher, and the term "low-softening point resin" refers to a resin having a softening point lower than 100° C. Such a system is preferable because of the following reason: the molecular weight distribution of the developer can be designed relatively easily, and a wide fixation region can be obtained. In addition, when the mass ratio falls within the above range, a moderate shear stress is applied at the time of the kneading, so good dispersibility of the magnetic iron oxide particles is apt to be obtained.

In the developer, a release agent (wax) can be used as required to obtain releasability. As the wax, in terms of dispersability in the magnetic toner particles and high releasability, hydrocarbon-type waxes such as low-molecular weight polyethylene, low-molecular weight polypropylene, a microcrystalline wax, and a paraffin wax are preferably used. One kind of release agent may be used alone or two or more kinds thereof may be used in combination, if necessary. The following may be given as examples.

Oxides of aliphatic hydrocarbon-type waxes such as a polyethylene oxide wax or block copolymers thereof; waxes mainly composed of fatty acid esters such as a carnauba wax, a sasol wax, and a montanic acid ester wax; and partially or wholly deacidified fatty acid esters such as a deacidified carnauba wax. The following can be further exemplified. Saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; long-chain alkyl alcohols; polyhydric alcohols such as sorbitol; fatty acid amides such as amide linoleate, amide oleate, and amide laurate; saturated fatty acid bisamides such as methylenebis amide stearate, ethylenebis amide caprate, ethylenebis amide laurate, and hexamethylenebis amide stearate; unsaturated fatty acid amides such as ethylenebis oleic acid amide, hexamethylenebis oleic acid amide, N,N'-dioleyl adipic acid amide, and N,N-dioleyl sebacic acid amide; aromatic bisamides such as m-xylene bisstearic acid amide and N,N-distearyl isophthalic acid amide; aliphatic metal salts (which are generally referred to as metallic soaps) such as calcium stearate, calcium laurate, zinc stearate, and magnesium stearate; waxes obtained by grafting aliphatic hydrocarbon-type waxes with vinyl-type monomers such as styrene and acrylic acid; partially esterified compounds of fatty acids and polyhydric alcohols such as behenic monoglyceride; and methyl ester compounds each having a hydroxyl group obtained by hydrogenation of vegetable oil.

Particularly preferably used release agents include aliphatic hydrocarbon-type waxes. Examples of the aliphatic hydrocarbon-type waxes include the following: a low-molecular weight alkylene polymer obtained by subjecting an alkylene to radical polymerization under high pressure or by polymerizing an alkylene under low pressure by using a Ziegler catalyst; an alkylene polymer obtained by thermal decomposition of a high-molecular weight alkylene polymer; a synthetic hydrocarbon wax obtained from a residue on distillation of a hydrocarbon obtained by an Arge method from a synthetic gas containing carbon monoxide and hydrogen, and a synthetic hydrocarbon wax obtained by hydrogenation of the gas; and waxes obtained by fractionating those aliphatic hydrocarbon-type waxes by using a press sweating method, a solvent method, vacuum distillation method or a fractional crystallization method. Of those, a small, saturated, and straight-chain hydrocarbon with a small number of branches is preferable, and a hydrocarbon synthesized by a method not involving the polymerization of an alkylene is particularly preferable because of its molecular weight distribution. Specific examples of the release agents that can be used include the following:

Biscol™ 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD.); Unilin™ 350, 425, 550, and 700 and Unisid™ 350, 425, 550, and 700 (TOYO-PETROLITE); and a haze wax, a beeswax, a rice wax, a candelilla wax, and a carnauba wax (CERARICA NODA Co., Ltd.).

The release agent may be added at the time of melt-kneading during the production of magnetic toner particles, or may be added at the time of producing the binder resin, thus the time of addition is appropriately selected from existing methods. In addition, one of those release agents may be used alone, or two or more of them may be used in combination.

The release agent is preferably added in an amount of 1 part by mass or more and 20 parts by mass or less with respect to 100 parts by mass of the binder resin. A releasing effect can be sufficiently obtained when the amount falls within the above range. In addition, good dispersibility in the magnetic toner particles can be obtained, and the adhesion of the developer to a photosensitive member and the contamination of the surface of a developing member or cleaning member can be suppressed.

A charge control agent can be incorporated into the developer for stabilizing the triboelectric chargeability of the developer. In general, the charge control agent is added in an amount of preferably 0.1 part by mass or more and 10 parts by mass or less, or more preferably 0.1 part by mass or more and 5 parts by mass or less, per 100 parts by mass of the binder resin, though the amount varies depending on the kinds of charge control agents and the physical properties of other components for the magnetic toner particles. The charge control agent is either a charge control agent for controlling the developer to be negatively chargeable or a charge control agent for controlling the developer to be positively chargeable. In the present invention, one or two or more kinds of charge control agents for controlling the developer to be negatively chargeable are preferably used depending on kinds and applications of developers.

Examples of the charge control agent for controlling the developer to be negatively chargeable include: organometallic complexes (such as a monoazo metal complex and an acetylacetone metal complex); and metal complexes or metal salts of aromatic hydroxy carboxylic acids or aromatic dicarboxylic acids. Other examples of the charge control agent for controlling the developer to be negatively chargeable include: aromatic monocarboxylic and polycarboxylic acids, and metal salts and anhydrides thereof; and esters and phenol derivatives such as bisphenol. Of those, a metal complex or metal salt of an aromatic hydroxy carboxylic acid is particularly preferably used because it provides stable charging performance. In addition, a charge control resin as well as such charge control agents as described above can be used.

Specific examples of the charge control agent which may be used include the following: Spilon Black TRH, T-77, and T-95 (Hodogaya Chemical Co., Ltd.); and BONTRON™ S-34, S-44, S-54, E-84, E-88, and E-89 (Orient Chemical Industries, LTD.).

In addition, an external additive is preferably added to each magnetic toner particle in the developer for improving the charging stability, developability, flowability, and durability; it is particularly preferable that a silica fine powder is externally added.

The silica fine powder preferably has a specific surface area by a BET method based on nitrogen adsorption in the range of 30 $m^2/g$ or more (particularly preferably 50 $m^2/g$ or more to 400 $m^2/g$ or less). The silica fine powder is used in an amount of preferably 0.01 part by mass or more and 8.00 parts by mass or less, or more preferably 0.10 part by mass or more and 5.00 parts by mass or less, with respect to 100 parts by mass of the magnetic toner particles. The BET specific surface area of the silica fine powder can be calculated by employing a BET multipoint method while causing a nitrogen gas to adsorb to the surface of the silica fine powder. A specific surface area-measuring apparatus (trade name: AUTOSORB 1; manufactured by Yuasa Ionics Inc., trade name: GEMINI 2360/2375; manufactured by Micromeritics Instrument Corporation, or trade name: Tristar 3000; manufactured by Micromeritics Instrument Corporation), or the like can be used in the measurement.

In addition, the silica fine powder may be treated with a treatment agent for making the powder hydrophobic or controlling the triboelectric chargeability. Examples of the treatment agent include unmodified silicone varnishes, modified silicone varnishes, unmodified silicone oils, various modified silicone oils, silane coupling agents, silane compounds each having a functional group, and other organic silicon compounds.

To the developer, other external additives may be added as required. Examples of such external additives include resin fine particles and inorganic fine particles each serving as a charging auxiliary agent, a conductivity-imparting agent, a flowability-imparting agent, a caking inhibitor, a release agent for a heat roller, a lubricant, an abrasive, or the like.

Examples of the lubricant include a polyethylene fluoride powder, a zinc stearate powder, and a polyvinylidene fluoride powder. Of those, a polyvinylidene fluoride powder is preferable.

Examples of the abrasive include a cerium oxide powder, a silicon carbide powder, and a strontium titanate powder. Of those, a strontium titanate powder is preferable.

Examples of the flowability-imparting agent include a titanium oxide powder and an aluminum oxide powder. Of those, a powder subjected to a hydrophobic treatment is preferable.

Examples of the conductivity-imparting agent include a carbon black powder, a zinc oxide powder, an antimony oxide powder, and a tin oxide powder.

Further, a small amount of white and black fine particles opposite in polarity to each other can also be used as a developability improver.

The manufacturing method for the developer of the present invention is not particularly limited and the developer may be obtained through a grinding method such as those described below. Magnetic toner particles are obtained by: sufficiently mixing a binder resin, a colorant and other additives by means of a mixer such as a Henschel mixer or a ball mill; melting and kneading the mixture by means of a heat kneader such as a heating roll, a kneader, or an extruder; then, cooling the kneaded product for solidification; and then, pulverizing and classifying the solidified product. Further, an external additive is sufficiently mixed with the magnetic toner particles as required by means of a mixer such as a Henschel mixer, whereby a developer is obtained.

Examples of the mixer include the following: Henschel mixer (manufactured by MITUI MINING. Co., Ltd.); Super Mixer (manufactured by KAWATA MFG Co., Ltd.); Ribocone (manufactured by OKAWARA CORPORATION); Nauta Mixer, Turburizer, and Cyclomix (manufactured by Hosokawa Micron); Spiral Pin Mixer (manufactured by Pacific Machinery & Engineering Co., Ltd.); and Loedige Mixer (manufactured by MATSUBO Corporation).

Examples of the kneader include the following: KRC kneader (manufactured by Kurimoto Ironworks Co., Ltd.); Buss Co-kneader (manufactured by Buss Co., Ltd.), TEM-type extruder (manufactured by TOSHIBA MACHINE Co., Ltd.); TEX Biaxial Kneader (manufactured by The Japan Steel Works, Ltd.); PCM Kneader (manufactured by Ikegai machinery Co.); Three-Roll Mill, Mixing Roll Mill, and Kneader (manufactured by Inoue Manufacturing Co., Ltd.); Kneadex (manufactured by Mitsui Mining Co., Ltd.); MS-type Pressure Kneader, and Kneader-Ruder (manufactured by Moriyama Manufacturing Co., Ltd.); and Banbury Mixer (manufactured by Kobe Steel, Ltd.).

Examples of the mill include the following: Counter Jet Mill, Micron Jet, and Inomizer (manufactured by Hosokawa Micron); IDS-type Mill and PJM Jet Mill (manufactured by Nippon Pneumatic MFG Co., Ltd.); Cross Jet Mill (manufactured by Kurimoto Tekkosho KK); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd.); Turbo Mill (manufactured by Turbo Kogyo Co., Ltd.); and Super Rotor (manufactured by Nisshin Engineering Inc.).

Examples of the classifier include the following: Classiel, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). Examples of the sifter for sieving crude particles include the following: Ultra Sonic (manufactured by Koei Sangyo Co., Ltd.); Rezona Sieve and Gyro Sifter (manufactured by Tokuju Corporation); Vibrasonic System (manufactured by Dalton Co., Ltd.); Sonicreen (manufactured by Shinto Kogyo K.K.); Turbo Screener (manufactured by Turbo Kogyo Co., Ltd.); Microsifter (manufactured by Makino mfg. co., Ltd.); and circular vibrating sieves.

<Developer Bearing Member 105>

The developer bearing member according to the present invention has at least a substrate, a resin layer as a surface layer formed on the substrate, and a magnetic member provided in the substrate. In addition, the resin layer contains the following materials (B1) to (B4), and is to subject the above developer to negative triboelectric charging:

(B1) a binder resin having at least one selected from a —$NH_2$ group, a ═NH group, and a —NH— bond in its structure;

(B2) a quaternary ammonium salt for reducing the property of the resin layer imparting negative triboelectric charges to the developer;

(B3) graphitized particles having a degree of graphitization p(002) of 0.22 or more and 0.75 or less; and (B4) conductive, spherical carbon particles having a volume-average particle diameter of 4.0 μm to 8.0 μm as particles for providing the surface of the resin layer with irregularities.

Further, the whole of the portion of the developer bearing member on which the developer is carried has a surface shape satisfying the following requirements (C1) to (C3):

(C1) multiple independent protrusions are present higher than $D_4/4$ with reference to an average (H) of three-dimensional heights measured at intersections of 725 straight lines parallel to one side of a square region 0.50 mm in side on the surface of the developer bearing member and 725 straight lines intersecting at right angles with the straight lines when the square region is equally divided by the straight lines;

(C2) the sum of the areas of the protrusions at a height of $D_4/4$ to is 5% or more and 30% or less of the area of the region; and (C3) arithmetic average roughness Ra(A) determined from only the protrusions is 0.25 μm or more and 0.55 μm or less, and arithmetic average roughness Ra(B) determined from portions excluding the protrusions is 0.65 μm or more and 1.20 μm or less.

<<Requirements (B)>>

The resin layer as the surface layer of the developer bearing member according to the present invention contains the following materials (B1) to (B4), and has the above property imparting negative triboelectric charges to the above developer:

(B1) a binder resin having at least one selected from a —$NH_2$ group, a ═NH group, and a —NH— bond in its structure;

(B2) a quaternary ammonium salt for reducing the property of the resin layer imparting negative triboelectric charges to the developer;

(B3) graphitized particles having a degree of graphitization p(002) of 0.22 or more and 0.75 or less; and (B4) conductive, spherical carbon particles having a volume-average particle diameter of 4.0 μm or more and 8.0 μm or less as particles for providing the surface of the resin layer with irregularities.

<<<Requirement (B3): Graphitized Particles>>>

The graphitized particles used in the present invention have a degree of graphitization p(002) of 0.22 or more and 0.75 or less. The degree of graphitization p(002) is called a Franklin's p value, and is determined from the following equation by measuring a grating space d(002) obtained from the X-ray diffraction spectrum of graphite: $d(002)=3.440-0.086(1-p2)$. The p value represents a ratio of a disordered portion of a stack of hexagonal network planes of carbon; the smaller the p value, the larger the degree of graphitization.

When the degree of graphitization p(002) is 0.22 or more and 0.75 or less, the triboelectric chargeability of the developer becomes good, and the developer can be subjected to triboelectric charging quickly. In addition, when the degree of graphitization of the graphitized particles falls within the range, since the hardness of graphitized particles increases, the abrasion resistance of the resin layer can be improved.

When the p(002) exceeds 0.75, graphitized particles become excellent in abrasion resistance, but their conductivity and lubricity are reduced. As a result, the charge-up of the developer is apt to occur, so a fluctuation in image density between before and after a pause is apt to occur. When the p(002) is less than 0.22, the abrasion resistance of the surface, the mechanical strength and the charge-providing performance of the resin layer for the developer may be reduced owing to the deterioration of the abrasion resistance of graphitized particles, so a fluctuation in image density is apt to occur.

The graphitized particles are preferably obtained by calcinating mesocarbon microbead particles or bulk mesophase pitch particles, or more preferably graphitized particles obtained by calcinating bulk mesophase pitch particles, in terms of abrasion resistance. Those particles are optically anisotropic and composed of a single phase, and hence, a degree of graphitization can be increased, and graphitized particles obtained by graphitizing the particles can hold an aggregated shape (substantially spherical). The optical isotropy of the mesocarbon microbead particles and bulk mesophase pitch particles results from the lamination of aromatic molecules, and the order of the laminated structure is enhanced through graphitizing treatment, whereby graphitized particles having a high degree of graphitization are obtained.

The graphitized particles obtained by the above method are different in its raw material and production step from crystalline graphite formed of artificial graphite or natural graphite and conventionally used in the resin layer on the surface of the developer bearing member. Accordingly, the graphitized particles each have high conductivity and high lubricity comparable to those of the crystalline graphite that has been conventionally used, though the graphitized particles have a degree of graphitization slightly lower than that of the crystalline graphite that has been conventionally used. Further, the graphitized particles have the following characteristics: the shape of the graphitized particles is an aggregated shape unlike the flaky shape or needle-like shape of the crystalline graphite that has been conventionally used, and the hardness of each particle itself is relatively high. Therefore, the graphitized particles used in the present invention can be uniformly dispersed in the resin layer with ease, so the surface of the resin layer can be provided with uniform surface roughness and abrasion resistance, and a change in surface shape of the resin layer can be suppressed to be small. Further, when the graphitized particles are used in the resin layer on the surface of the developer bearing member, the property of the resin layer imparting triboelectric charges to the developer can be improved as compared with the case where the conventional crystalline graphite is used.

When the mesocarbon microbead particles are used as raw materials for obtaining the graphitized particles used in the present invention, the mesocarbon microbead particles are preferably subjected to mechanical primary dispersion with such mild force that the particles are not broken. This is because graphitized particles are inhibited from coalescing, and a uniform grain size can be obtained.

The mesocarbon microbead particles that have undergone the primary dispersion are subjected to primary heating treatment at a temperature of 200° C. to 1,500° C. under an inert atmosphere so as to be carbonized. As in the case of the foregoing, the carbides that have undergone the primary heating treatment are preferably subjected to mechanical dispersion (secondary dispersion treatment) with such mild force that the carbides are not broken in order that graphitized particles are inhibited from coalescing, and a uniform grain size can be obtained.

The carbides that have undergone the secondary dispersion treatment are subjected to secondary heating treatment at about 2,000° C. to 3,500° C. under an inert atmosphere, whereby desired graphitized particles are obtained. A representative method of obtaining the mesocarbon microbead particles will be described below. First, coal heavy oil or petroleum heavy oil is subjected to heat treatment at a temperature of 300° C. to 500° C. so as to be subjected to polycondensation. Thus, coarse mesocarbon microbead particles are produced. The produced coarse mesocarbon microbead particles are subjected to treatment such as filtration, static sedimentation, or centrifugal separation so that mesocarbon microbead particles can be separated. After that, the separated particles are washed with a solvent such as benzene, toluene, or xylene, and furthermore, are dried. Thus, the mesocarbon microbead particles are obtained.

Next, the case where the bulk mesophase pitch particles are used as raw materials for obtaining the graphitized particles used in the present invention will be described. In order that the bulk mesophase pitch particles may be graphitized, first, the bulk mesophase pitch particles are finely pulverized into particles having a size of 2 μm to 25 μm, and the fine particles are subjected to heat treatment at about 200° C. to 350° C. in the air so that the particles can be lightly oxidized. Only the surfaces of the bulk mesophase pitch particles are made infusible by the oxidation treatment, so the particles are inhibited from melting or melt-adhering at the time of graphitizing heat treatment in the next step. The oxidized bulk mesophase pitch particles preferably have an oxygen content of 5 mass % to 15 mass %. When the oxygen content is less than 5 mass %, the melt adhesion of the particles at the time of the heat treatment may be promoted. In addition, when the oxygen content exceeds 15 mass %, even the insides of the particles are oxidized, and the particles are graphitized while having crushed shapes, with the result that spherical particles are difficult to obtain in some cases.

Next, the above oxidized bulk mesophase pitch particles are subjected to heat treatment at about 2,000° C. to 3,500° C. under an inert atmosphere such as nitrogen or argon, whereby desired graphitized particles are obtained.

A method of obtaining the bulk mesophase pitch particles is, for example, a method involving extracting β-resin from coal tar pitch by solvent separation and subjecting the β-resin to hydrogenation and heavy treatment to provide the bulk mesophase pitch particles, or a method involving finely pulverizing the resultant after the heavy treatment and removing solvent-soluble matter with benzene, toluene, or the like to provide the bulk mesophase pitch particles.

The bulk mesophase pitch particles used in the present invention preferably have quinoline-soluble matter at a content of 95 mass % or more. When particles having quinoline soluble matter in a content of less than 95 mass % are used, the insides of the particles are difficult to subject to liquid-phase carbonization, and hence, are subjected to solid-phase carbonization, so the particles maintain their crushed shapes, and spherical particles are not obtained in some cases.

In a method of producing the graphitized particles involving the use of one of the above raw materials, the calcination temperature of the graphitized particles is preferably 2,000° C. to 3,500° C., or more preferably 2,300° C. to 3,200° C. When the calcination temperature is lower than 2,000° C., the graphitization degree of the graphitized particles insufficient, and their conductivity and lubricity are lowered, and the charge-up of the developer at the time of continuous printing occurs in some cases, so a fluctuation in image density between before and after a pause is apt to occur. When the calcination temperature exceeds 3,500° C., the graphitized particles may have an excessively high degree of graphitization. As a result, the hardness of the graphitized particles is lowered, and the abrasion resistance of the surface of the resin layer, the mechanical strength of the resin layer and the property of the resin layer imparting charges to the developer are lowered owing to the deterioration of the abrasion resistance of the graphitized particles in some cases, so image density is apt to fluctuate. In addition, irrespective of a method of producing the graphitized particles from one of the raw materials, the grain size distribution of the graphitized particles is preferably uniformized to some extent by classification in order that the surface shape of the resin layer can be uniformized.

When measurement is made in a section of the resin layer, the arithmetic average particle diameter (Dn) of the graphitized particles used in the present invention is preferably 0.50 μm or more and 3.00 μm or less. In this case, the effect of providing the surface of the resin layer with uniform roughness and the effect of improving the charging performance of the resin layer are high, and hence the developer can be quickly and stably charged. In addition, the charge-up, contamination, and melt adhesion of the developer in association with the abrasion of the resin layer are difficult to bring about. As a result, a fluctuation or reduction in image density can be effectively suppressed. Further, a fluctuation in image density between before and after a pause can be more effectively suppressed.

<<<Conductive Agent>>>

In the present invention, a conductive agent may be dispersed and incorporated in the resin layer together with the graphitized particles for the purpose of adjusting the volume resistivity of the resin layer. The conductive agent used in the present invention is, for example, conductive fine particles having a number-average particle diameter of 1 μm or less, or preferably 0.01 to 0.8 μm. When the number-average particle diameter of the conductive fine particles exceeds 1 μm, it becomes difficult to control the volume resistivity of the resin layer to a low value, and the contamination of the developer due to the charge-up of the developer is liable to occur.

Examples of the conductive agent include: fine particles of powdered metals such as aluminum, copper, nickel, and silver; metal oxides such as antimony oxide, indium oxide, tin oxide, titanium oxide, zinc oxide, molybdenum oxide, and potassium titanate; carbon black such as carbon fiber, furnace black, lamp black, thermal black, acetylene black, and channel black; carbides such as graphite; and metallic fibers.

Of those, carbon black, especially, conductive, amorphous carbon is suitably used in the present invention. This is for the following reasons: carbon black is particularly excellent in electric conductivity, and is incorporated into a polymer material to impart conductivity to the polymer material, and the conductivity can be changed arbitrarily to some extent merely by controlling the amount of carbon black to be added. In addition, in the present invention, such conductive substance is preferably added in an amount ranging from 1 part by mass to 100 parts by mass with respect to 100 parts by mass of the binder resin. When the amount is less than 1 part by mass, it is usually difficult to lower the resistivity of the resin layer to a desired level. When the amount exceeds 100 parts by mass, the strength (abrasion resistance) of the resin layer may be reduced particularly in the case where a fine powder having a grain size of the order of submicrons is used.

It should be noted that the volume resistivity of the resin layer is preferably $10^4\Omega\cdot$cm or less, or more preferably $10^{-3}\Omega\cdot$cm or more and $10^3\Omega\cdot$cm or less. When the volume resistivity of the resin layer exceeds $10^4\Omega\cdot$cm, the charge-up of the developer may occur at the time of continuous printing, so a fluctuation in image density between before and after a pause is apt to occur.

<<<Requirements (B1) and (B2)>>>

The resin layer used in the present invention has: a binder resin having at least one of a —$NH_2$ group, a ═NH group, and a —NH— bond in its structure; and a quaternary ammonium salt for reducing the negative triboelectric charge-providing performance of the binder resin.

The quaternary ammonium salt suitably used in the present invention is uniformly dispersed in a resin having one of a —$NH_2$ group, a ═NH group, and a —NH— bond in its structure, though the reason for the foregoing is not clear. Upon proceeding with crosslinking by the curing of the resin with heat, the quaternary ammonium salt undergoes a certain interaction with the —$NH_2$ group, ═NH group, or —NH— bond to enter the skeleton of the binder resin. Then, the binder resin with the quaternary ammonium salt incorporated therein starts to exert the charge polarity of the counter ion of a quaternary ammonium ion. As a result, the resin layer serves to prevent the negative triboelectric charge quantity of the developer at the time of continuous printing duration from gradually becoming excessive, though the resin layer has the above-mentioned performance to subject the developer according to the present invention to negative triboelectric charging (hereinafter referred to as "negative triboelectric charge-providing performance"). That is, the negative triboelectric charge-providing performance of the resin layer for the developer is lowered. As a result, the negative triboelectric charge quantity of the developer can be controlled.

<<<Requirement (B1): Binder Resin>>>

As substances including an —$NH_2$ group, following may be cited.

Primary amines represented by R—$NH_2$ or polyamines including the primary amines, and primary amides represented by RCO—$NH_2$ or polyamides including the primary amides.

As substances including an ═NH group, following may be cited.

Secondary amines represented by R═NH or polyamines including the secondary amines, and secondary amides represented by $(RCO)_2$═NH or polyamides including the secondary amides.

As substances including an —NH— bond, following may be cited.

Other than the polyamines and polyamides as above, polyurethanes including —NHCOO— bonds are exemplified. Industrially synthesized resins including one or two or more kinds of substances as above or including these substances in copolymer form.

Of those, a phenol resin, a polyamide resin, and a urethane resin each using ammonia as a medium are preferable in terms of versatility, and the phenol resin is more preferable in terms of strength when the resin is formed into the resin layer. A phenol resin having one of a —$NH_2$ group, a ═NH group, and a —NH— bond is, for example, a phenol resin produced by using as a catalyst a nitrogen-containing compound such as ammonia in its production steps. The nitrogen-containing compound as a catalyst is directly involved in the polymerization reaction, and is present in the phenol resin even after the completion of the reaction. For example, it has been generally confirmed that, when the polymerization is performed in the presence of an ammonia catalyst, an intermediate called ammonia resol is produced; even after the completion of the reaction, the ammonia catalyst is present in the phenol resin while forming such structure as represented by the following structural formula (3).

Structural formula (3)

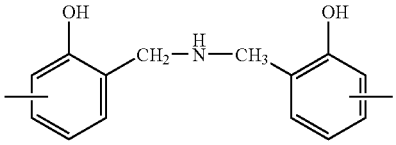

The nitrogen-containing compound suitably used in the present invention may be an acidic catalyst or a basic catalyst. Examples of the acidic catalyst include ammonium salts or amine salts such as ammonium sulfate, ammonium phosphate, ammonium sulfamate, ammonium carbonate, ammonium acetate, or ammonium maleate. Examples of the basic catalyst include: ammonia; amino compounds such as dimethylamine, diethylamine, diisopropylamine, diisobutylamine, diamylamine, trimethylamine, triethylamine, tri-n-butylamine, triamylamine, dimethylbenzylamine, diethylbenzylamine, dimethylaniline, diethylaniline, N,N-di-n-butylaniline, N,N-diamylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine, and hexamethylenetetramine; pyridines and derivatives thereof such as pyridine, α-picoline, β-picoline, γ-picoline, 2,4-lutidine, and 2,6-lutidine; and nitrogen-containing heterocyclic compounds such as imidazoles and derivatives thereof, for example, quinoline compounds, imidazole, 2-methylimidazole, 2,4-dimethylimidazole, 2-ethyl-4-methylimidazole, 2-phenylimidazole, 2-phenyl-4-methylimidazole, and 2-heptadecylimidazole. It is possible to analyze the structures of those phenol resins by, for example, infrared spectroscopy (IR) or nuclear magnetic resonance (NMR).

As the polyamide resins, the following may be preferably used: nylon 6, 66, 610, 11, 12, 9, 13; Q2 nylon; nylon copolymers including those nylons as a main component; N-alkyl modified nylon; and N-alkoxylalkyl modified nylon. Further, the following may be preferably used: resins containing polyamide resins, for example, various resins modified with polyamides, such as a polyamide-modified phenol resin, or an epoxy resin in which a polyamide resin is used as a curing agent.

Any resin may be preferably used as the urethane resin as long as the resin includes urethane bonds. The urethane bonds are attained by addition polymerization reaction between polyisocyanate and polyol.

Examples of the polyisocyanate used as a main raw material for the polyurethane resin include diphenylmethane-4,4'-diisocyanate (MDI), isophorone diisocyanate (IPDI), polymethylene polyphenyl polyisocyanate, tolylene diisocyanate, hexamethylene diisocyanate, 1,5-naphthaline diisocyanate, 4,4'-dicyclohexylmethane diisocyanate, carbodiimide-modified diphenylmethane-4,4'-diisocyanate, trimethylhexamethylene diisocyanate, orthotoluidine diisocyanate, naphthylene diisocyanate, xylene diisocyanate, paraphenylene diisocyanate, lysine diisocyanate methyl ester, and dimethyl diisocyanate.

Examples of the polyol used as a main raw material for the polyurethane resin include the following:

Polyester polyols such as polyethylene adipate, polybutylene adipate, polydiethylene glycol adipate, polyhexene adipate, and polycaprolactone ester; and polyether polyols such as polytetramethylene glycol and polypropylene glycol.

<<<Requirement (B2): Quaternary Ammonium Salt>>>

As quaternary ammonium salts, substances represented by the following structural formula (4) are exemplified.

Structural formula (4)

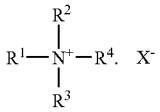

In the above structural formula (4), $R^1$ to $R^4$ each independently represent an alkyl group which may have a substituent, or an aryl or aralkyl group which may have a substituent, and $X^-$ represents an anion of an acid. Examples of the acid ion represented by $X^-$ in the above structural formula (4) include an organic sulfate ion, an organic sulfonate ion, an organic phosphate ion, a molybdate ion, a tungstate ion, and a heteropoly acid containing a molybdenum atom or tungsten atom.

Examples of the quaternary ammonium salt suitably used in the present invention include those listed in Tables I to III below.

TABLE I

| Exemplary Compound No. | 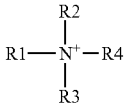 | $X^-$ |
|---|---|---|
| 1 | 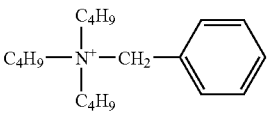 | 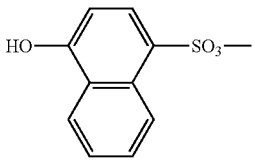 |

TABLE I-continued
| Exemplary Compound No. | $R1-N^{+}(R2)(R3)-R4$ | $X^{-}$ |
|---|---|---|
| 2 | 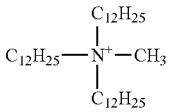 | 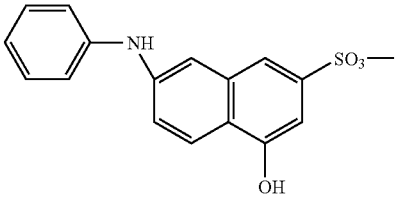 |
| 3 | 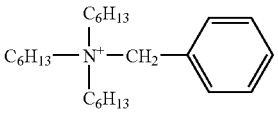 | 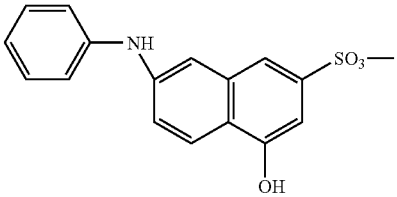 |
| 4 | 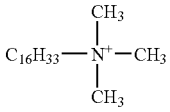 | $1/4Mo_8O_{26}^{4-}$ |
| 5 | 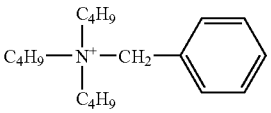 | 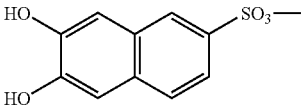 |
| 6 | 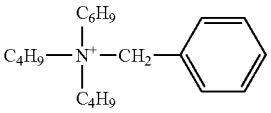 | 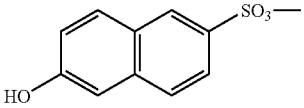 |
| 7 | 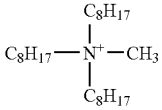 | 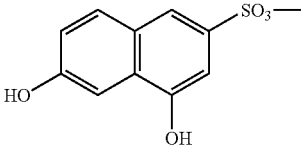 |
| 8 | 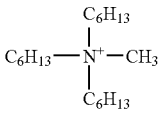 | 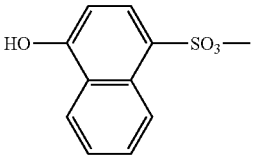 |

TABLE II
| Exemplary Compound No. | $R1-N^{+}(R2)(R3)-R4$ | $X^{-}$ |
|---|---|---|
| 9 | 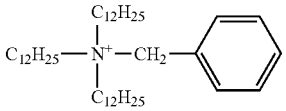 | 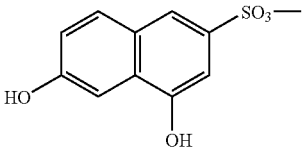 |
| 10 | 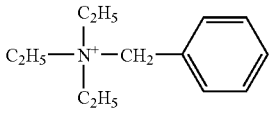 | 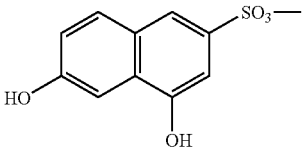 |
| 11 | 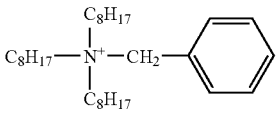 | 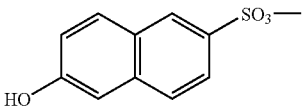 |
| 12 | 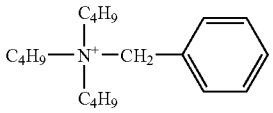 | 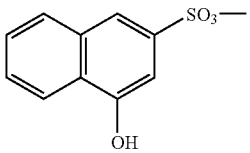 |
| 13 | 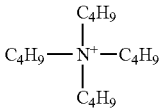 | 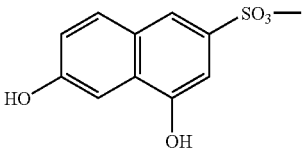 |
| 14 | 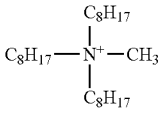 | 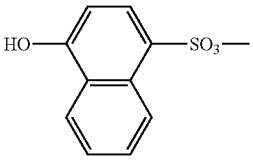 |
| 15 | 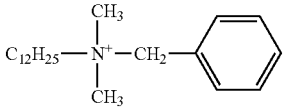 | 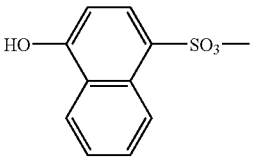 |
| 16 | 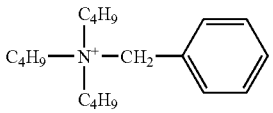 | 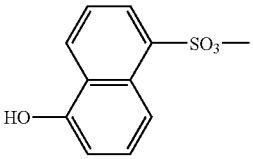 |

TABLE III

| Exemplary Compound No. | R2<br>\|<br>R1—N+—R4<br>\|<br>R3 | X− |
|---|---|---|
| 17 | $C_6H_{13}$<br>\|<br>$C_6H_{13}$—N+—$CH_3$<br>\|<br>$C_6H_{13}$ | 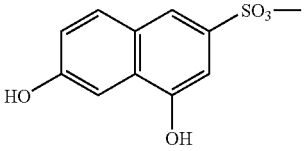 |
| 18 | $C_4H_9$<br>\|<br>$C_4H_9$—N+—$C_4H_9$<br>\|<br>$C_4H_9$ | 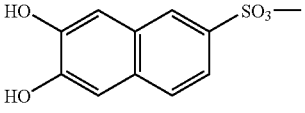 |
| 19 | $CH_3$<br>\|<br>$C_8H_{17}$—N+—$CH_2$—<br>\|<br>$CH_3$ | 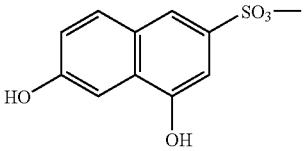 |

When the resin layer formed by using in combination the above quaternary ammonium salt and the resin having a specific structure is formed on the developer bearing member, the resin layer serves to prevent excessive triboelectric charging of the developer, whereby the negative triboelectric charge quantity of the developer can be controlled. Thus, the charge-up of the developer on the developer bearing member can be prevented, and the triboelectric charging stability of the developer can be held. As a result, a fluctuation in image density can be suppressed.

The content of the quaternary ammonium salt in the resin layer is preferably 5 parts by mass to 50 parts by mass with respect to 100 parts by mass of the binder resin in the resin layer. In this case, the triboelectric charge quantity of the developer used in the present invention can be easily controlled to a stable value. Setting the content of the quaternary ammonium salt within the above range can effectively suppress the charge-up of the developer. In addition, a reduction in image density due to an excessive reduction in triboelectric charge quantity of the developer can be suppressed.

<<(B4): Conductive, Spherical Carbon Particles>>

Irregularity-providing particles used in the present invention are conductive, spherical carbon particles having a volume-average particle diameter of 4.0 μm to 8.0 μm.

The conductive, spherical carbon particles are added for reducing a change in surface roughness of the resin layer of the developer bearing member so as to be difficult the contamination and melt adhesion of the developer to bring about and for providing the surface of the resin layer with such a desired surface shape as described later. In addition, the conductive, spherical carbon particles interact with the graphitized particles in the resin layer to exert the following effects: the conductive, spherical carbon particles enhance the charging performance of the graphitized particles, enhance the quick and stabilized chargeability, and suppress a fluctuation in image density.

The term "spherical" in the conductive, spherical carbon particles used in the present invention is not limited to a perfectly spherical shape, but refers to a particle having a ratio of its major axis to its minor axis of 1.0 to 1.5. In the present invention, spherical particles each having a ratio of its major axis to its minor axis of 1.0 to 1.2 are more preferably used, and perfectly spherical particles are particularly preferably used. When the spherical particles are each caused to have a ratio of its major axis to its minor axis in the above numerical value range, the dispersibility of the spherical particles in the resin layer becomes good. Accordingly, such spherical particles are effective in: uniformizing the roughness of the surface of the resin layer; stably imparting charges to the developer; and maintaining the strength of the resin layer.

In the present invention, the major axes and minor axes of the conductive, spherical carbon particles were measured with an enlarged photograph obtained by photographing the particles with an electron microscope at a magnification of 6,000. The major axes and minor axes of 100 samples randomly selected from the enlarged photograph were measured, the ratios of the major axes and the minor axes of the particles were determined, and the average of the ratios was defined as the ratio of the major axis to the minor axis of each of the particles.

In the case where the volume-average particle diameter of the conductive, spherical carbon particles is less than 4.0 μm, the effects of imparting the surface of the resin layer to desired roughness and improving the charging performance of the resin layer are less, and the quick, stable charging of the developer used in the present invention becomes insufficient, so a fluctuation in image density is apt to occur. In addition, conveying force for the developer is reduced, so a reduction in image density is apt to occur. Accordingly, the above case is not preferable. In the case where the volume-average particle diameter exceeds 8.0 μm, the surface of the resin layer cannot obtain desired roughness, and it is difficult for the developer used in the present invention to be sufficiently charged, so a reduction in image density is apt to occur.

In addition, a variation coefficient determined from the grain size distribution of the conductive, spherical carbon particles on the basis of volume is preferably 40% or less, or more preferably 30% or less. Setting the variation coefficient to 40% or less makes it easy to provide the surface of the resin layer with a desired surface shape.

A method of obtaining the conductive, spherical carbon particles of the present invention is preferably, but not necessarily limited to, any one of the following methods.

As a method of obtaining the conductive, spherical carbon particles used in the present invention is, for example, a method may be cited in which spherical resin particles or mesocarbon microbeads are calcined and carbonized and/or graphitized, thereby obtaining spherical carbon particles each having low density and good conductivity.

A resin used in the spherical resin particles is, for example, a phenol resin, a naphthalene resin, a furan resin, a xylene resin, a divinylbenzene polymer, a styrene-divinylbenzene copolymer, or polyacrylonitrile.

A preferable method of obtaining the conductive; spherical carbon particles is as described below. First, the surfaces of the spherical resin particles are coated with bulk mesophase pitch by a mechanochemical method. Next, the coated particles are subjected to heat treatment under an oxidizing atmosphere, and are then calcined under an inert atmosphere or in vacuum so as to be carbonized and/or graphitized. Thus, conductive, spherical carbon particles carbonized inside and graphitized outside are obtained. This method is preferable because the crystallization of the coated portion of each of the conductive, spherical carbon particles obtained by the graphitization is developed, and the conductivity of the particles is improved. The conductive, spherical carbon particles obtained by the above method are preferably used in the present invention because the conductivity of the conductive, spherical carbon particles to be obtained can be controlled by changing conditions for the calcination.

<<Requirements (C1) to (C3)>>

The requirements (C1) to (C3) will be described which specify the surface shape which the whole area of the developer bearing member on which the developer is carried should have.

<<<Requirement (C1)>>>

When a square region 0.50 mm in side on the surface of the developer bearing member is equally divided with 725 straight lines parallel to one side of the square region and 725 straight lines intersecting at right angles with the former 725 straight lines, a plurality of independent protrusions are present in the square region higher than $D_4/4$ with reference to an average (H) of three-dimensional heights measured at the intersections of the former 725 straight lines and the latter 725 straight lines.

The reason for specifying the surface shape of the resin layer with the three-dimensional heights is as described below.

A method of measuring the surface shape of the developer bearing member is defined in JIS (B0601-2001). JIS (B0601-2001) describes only a two-dimensional measurement method, and the inventors of the present invention have considered the method to be insufficient for accurately grasping an actual contact phenomenon between the developer bearing member and the developer. In addition, the developer bearing member is contacted with a developer having a particle diameter of several micrometers to perform triboelectric charging. In view of the foregoing, the inventors of the present invention have considered that when three-dimensional measurement of the surface shape of the developer bearing member is microscopically conducted, the developability relationship between the developer bearing member and the developer can be presented in a more favorable fashion.

The three-dimensional heights can be measured with a confocal optical laser microscope. The confocal optical laser microscope applies laser emitted from a light source to an object, and measures the shape of the object on the basis of information on the position of an objective lens where the light quantity of laser reflected from the object to be received by a light-receiving element at a confocal position becomes maximum. The confocal optical laser microscope is suitable for microscopic measurement because the confocal optical laser microscope can measure the surface shape of the developer bearing member at intervals of 1 μm or less, though the intervals varies depending on the magnification of the lens.

Figure 2:
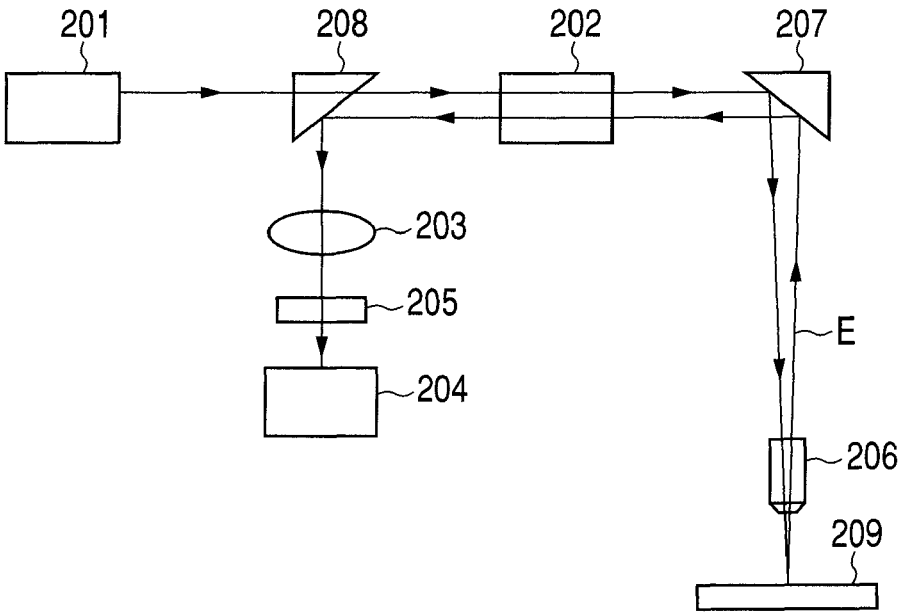
FIG. 2 is a schematic view of a confocal optical laser microscope.
Figure 3:
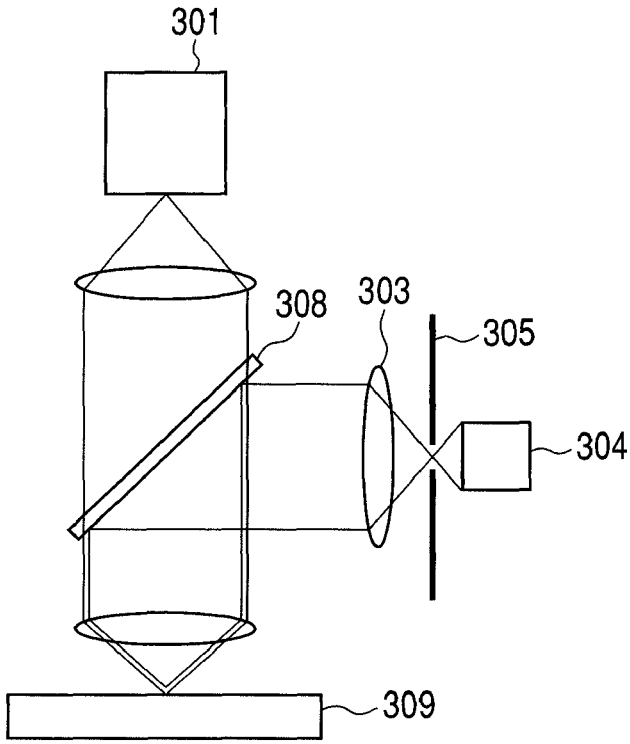
FIG. 3 is a schematic view showing the behavior of laser light from the confocal optical laser microscope at the time of focusing.
Figure 4:
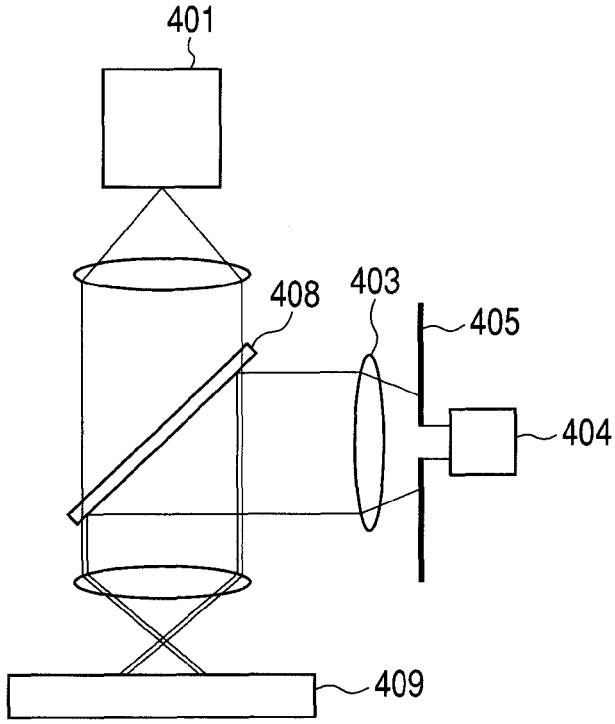
FIG. 4 is a schematic view showing the behavior of laser light from the confocal optical laser microscope at the time of defocusing.

Hereinafter, the measurement principle of the confocal optical laser microscope will be described in detail by taking as an example a confocal optical laser microscope (trade name: VK-8710; manufactured by KEYENCE CORPORATION) used in the measurement of the surface shape of the resin layer of the developer bearing member in EXAMPLES to be described later. FIG. 2 is a schematic view showing the device constitution of the confocal optical laser microscope. Reference character E in the figure schematically shows the path of laser light. Since a laser light source 201 is a point light source, an observation object (developer bearing member) 209 is scanned with the light source through an X-Y scan optical system 202 by dividing an observation region into 1,024×768 pixels. Reflected light from each pixel is detected by a light-receiving element 204 through a condensing lens 203. In this case, laser light from a position except a focal position can be removed by a pinhole 205 provided between the condensing lens 203 and the light-receiving element 204, so the displacement (height information) of the focal position can be sensed with the quantity of received light. To be specific, as shown in FIG. 3, at the time of focusing, reflected light from an observation object 309 passes through a pinhole 305 to enter a light-receiving element 304; as shown in FIG. 4, at the time of defocusing, only part of reflected light from an observation object 409 passes through a pinhole 405 to enter a light-receiving element 404. The time of focusing and the time of defocusing can be distinguished from each other on the basis of a difference in quantity of received light, whereby height information is obtained. Scanning is repeated while an objective lens 206 is driven in a vertical (Z-axis) direction. Thus, the quantity of reflected light of each pixel for a Z-axis position is obtained. The position of the lens at which the light quantity of reflected laser becomes maximum is defined as the focal position of the lens (position at which the objective lens is focused), and the light quantity of reflected laser in this case is stored in a memory. At the same time, information on the position of the lens is memorized as height information. Thus, data on the three-dimensional heights in the observation region is obtained. In FIGS. 2 to 4, reference numerals 207, 208, 308, and 408 represent half mirrors, reference numerals 301 and 401 represent laser light sources, and reference numerals 303 and 403 represent condensing lenses.

Three-dimensional heights were measured for a square region 0.50 mm in side on the surface of the developer bearing member at intersections (725×725) of 725 straight lines parallel to one side of the square region and 725 straight lines perpendicular to the straight lines when the square region is equally divided by the straight lines. Then, an average (H) of those values is set as a reference indicative of the irregular state of the resin layer. Then, multiple independent protrusions having a height in excess of a quarter of the weight-average particle diameter $D_4$ of the developer with reference to the average (H) are caused to exist in the region. That is, according to the investigation conducted by the inventors of the present invention, it has been found that protrusions having a height in excess of $H+(D_4/4)$ largely contribute to the triboelectric chargeability of the developer while portions except the protrusions largely contribute to the conveying property of the developer. Therefore, for the control of the triboelectric chargeability of the developer, it is an important premise that multiple independent protrusions having a height in excess of $H+(D_4/4)$ are present in the above region.

<<<Requirement (C2)>>>

Next, a ratio of the total sum of the areas of the protrusions having a height in excess of $H+(D_4/4)$ at $H+(D_4/4)$ to the area of the above region according to the requirement (C2) gives an indicator of whether a frequency at which the protrusions and the developer are contacted with each other is high or low. Setting the value to 5% or more and 30% or less, or particularly 10% or more and 20% or less makes suitable a frequency at which the protrusions and the developer are contacted with each other. Accordingly, the requirement is extremely important in controlling the chargeability of the developer. In addition, setting the value within the numerical value range makes it possible to secure sufficiently the areas of portions having a height of $H+(D_4/4)$ or less which contributes to the conveyance of the developer. Accordingly, the requirement is extremely important also in maintaining the good conveying property of the developer.

<<<Requirement (C3)>>>

Further, an arithmetic average roughness Ra(A) determined from only the above protrusions having a height in excess of $H+(D_4/4)$ related to the requirement (C3) determines the triboelectric charging performance of the developer due to the protrusions under the specifications according to the above requirements (C1) and (C2). Then, setting the above Ra(A) within the range of 0.25 μm or more to 0.55 μm or less makes suitable the triboelectric charging due to contact between the protrusions and the developer. As a result, the developer can be charged to the extent sufficient for good image formation while the charge-up of the developer due to excessive triboelectric charging is suppressed.

An arithmetic average roughness Ra(B) determined from area other than the protrusions, determines the developer-conveying performance of the developer bearing member according to the present invention. Setting the above Ra(B) within the range of 0.65 μm or more to 1.20 μm or less enables the developer to be reliably conveyed. In addition, insufficient charging of the developer due to an excessively large developer-conveying property can be suppressed.

In addition, an arithmetic average roughness Ra(Total) indicative of the surface shape of the surface layer calculated without separating the above protrusions having a height exceeding $H+(D_4/4)$ from the other area is preferably set to fall within the range of 0.60 μm or more to 1.40 μm or less. Setting the Ra(Total) within the numerical value range makes it possible to adjust each of the arithmetic average roughness Ra(A) of the protrusions, the areas of the regions of the protrusions and the arithmetic average roughness Ra(B) of depressed portions in the present invention within more preferable ranges. That is, when the arithmetic average roughness Ra(Total) is 0.60 μm or more, the force of conveying the developer hardly becomes insufficient, and excessive triboelectric charging of the developer hardly occurs, so a fluctuation in image density can be further suppressed. When the arithmetic average roughness Ra(Total) is 1.40 μm or less, excessive conveyance of the developer and insufficient triboelectric charging of the developer hardly occur, so a fluctuation in image density can be further suppressed.

In addition, an average (U) of universal hardnesses (HU) defined in ISO/FDIS14577 of the resin layer of the developer bearing member is preferably 400 $N/mm^2$ or more and 650 $N/mm^2$ or less. In the present invention, the universal hardnesses HU of the surface of the resin layer were measured with a Fischerscope H100V (trade name) manufactured by Fischer Instruments KK in conformity with ISO/FDIS14577. A quadrangular-pyramidal diamond indenter having an angle between its opposite faces of 136° was used in the measurement. The indenter is pushed into a film while a measuring load is applied in stages, and an indentation depth h (unit: mm) is measured in a state in which a load is applied. The universal hardness HU is determined by substituting the test load (unit: N) and the indentation depth for F and h in the following equation (5) where a coefficient K is 1/26.43.

$$HU=K\times F/h^2[N/mm^2] \quad \text{Eq. (5)}$$

The universal hardness HU can be measured with a smaller load than that in the case of any other hardness (such as Rockwell hardness or Vickers hardness). In addition, the universal hardness HU is suitable for evaluating the hardness of a material having elasticity or plasticity because hardness including an elastic or plastic deformation component can be obtained.

Setting the average (U) of the universal hardnesses HU of the surface of the resin layer within the above numerical value range makes it possible to secure the durability of the resin layer sufficiently and to suppress a fluctuation in image density in association with the use of the developer effectively. In addition, the hardness at such a level eliminates the need for adding a large amount of high-hardness particles for improving the durability. Accordingly, the triboelectric chargeability of the developer by the resin layer is not impaired.

<<Method of Producing Resin Layer>>

Next, a method of producing the resin layer of the developer bearing member satisfying the above requirements (B1) to (B4) and (C1) to (C3) will be described.

The resin layer satisfying the above requirements (B1) to (B4) and (C1) to (C3) can be formed by, for example, dispersing and mixing the respective components of the resin layer in a solvent to prepare a coating liquid, applying the coating liquid onto a substrate, and drying the resultant to solidify or curing the resultant. Further, subjecting the surface of the resin layer obtained by the solidification through drying or by the curing to polishing by a predetermined method to be described later is extremely effective in obtaining the developer bearing member satisfying the above requirements.

First, a known dispersing apparatus utilizing beads such as a sand mill, a paint shaker, a dyno-mill, or a pearl mill can be suitably utilized in the dispersion and mixing of the respective components of which the resin layer is formed in the coating liquid. In this case, the beads have a particle diameter of preferably 0.8 mm or less, or more preferably 0.6 mm or less in order that the respective components may be uniformly dispersed and mixed in the coating liquid.

In addition, a known method such as a dipping method, a spray method, or a roll coat method is applicable as a method of applying the resultant coating liquid to the substrate; the spray method is preferable in order that the surface shape of the resin layer of the developer bearing member used in the present invention may be formed.

A method of atomizing the paint upon application by the spray method is, for example, any one of the following methods: an atomization method involving the use of air, a mechanical atomization method involving rotating a disk or the like at a high speed, an atomization method involving ejecting the coating liquid itself through the application of pressure to the coating liquid to cause the coating liquid to collide with the external air, and an atomization method involving the use of ultrasonic vibration. Of those, the air spray method involving atomizing the coating liquid with air is a preferable method of forming the resin layer of the developer bearing member according to the present invention for the reason that strong force to turn the coating liquid into fine particles is applied, so the paint can be uniformly applied with ease.

The air spray method involves: vertically raising the substrate so that the substrate may be parallel to the direction in which a spray gun moves; keeping the distance between the substrate and the nozzle tip of the spray gun constant while rotating the substrate; and applying the coating liquid in which the respective components are dispersed and mixed to the substrate while raising or lowering the spray gun at a constant speed. The moving speed of the spray gun is preferably 10 mm/s or more and 50 mm/s or less. The moving speed is preferably set to fall within the range for the reason that the degree of non-uniformity or wrinkles at the time of the application can be easily reduced, so the resin layer can be uniformly formed with ease. The rotational speed of the substrate is preferably set as appropriate depending on the diameter of the substrate to be used; when the rotating speed is set to 500 rpm or more and 2,000 rpm or less, application non-uniformity hardly occurs, and a desired surface shape can be easily obtained.

In addition, the distance between the substrate and the nozzle tip is preferably set as appropriate depending on the coating liquid to be used; when the distance is set to 30 mm or more and 70 mm or less, a desired surface shape can be easily obtained. The surface shape of the resin layer tends to be roughened as the distance from the substrate increases.

Further, the thickness of the resin layer is set to preferably 50 μm or less, more preferably 40 μm or less, or still more preferably 4 μm to 30 μm because the resin layer can be uniform and can be provided with a surface shape suitable for the present invention.

The surface roughness of the coating film tends to increase as the solid content in the coating liquid is reduced. In addition, the surface roughness of the coating film tends to increase as the distance between the substrate and the nozzle tip of the spray gun increases. Therefore, when a resin layer having a specific surface shape is formed, a resin layer having a surface shape satisfying the above requirements (C1) to (C3) can be formed by appropriately adjusting the solid content in the coating liquid and the distance between the substrate and the nozzle tip of the spray gun.

Figure 5:
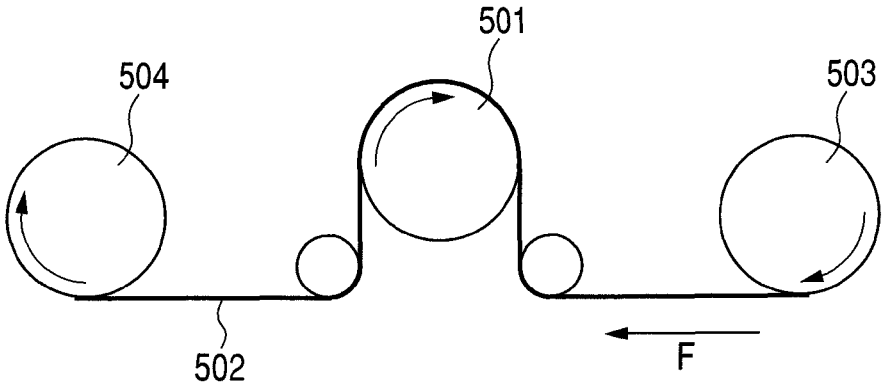
FIG. 5 is a schematic view showing the section of an example of a polishing apparatus in the present invention.

In addition, in order to obtain the developer bearing member used in the present invention, the resin layer having a predetermined surface shape obtained by the above-mentioned predetermined method is preferably subjected to polishing with a strip-shaped abrasive carrying abrasive particles on its surface. FIG. 5 is a schematic sectional view showing an example of a polishing apparatus in the present invention. A developer bearing member 501 is rotated clockwise or counterclockwise, and a strip-shaped abrasive 502 is brought into press contact with the developer bearing member 501 while being delivered from a delivery roller 503. Thus, the strip-shaped abrasive 502 is moved toward a take-up roller 504 in the direction indicated by an arrow F. In this case, the strip-shaped abrasive 502 rubs against the developer bearing member 501 at the position where the strip-shaped abrasive 502 and the developer bearing member 501 abut each other. The protrusions of the resin layer of the developer bearing member 501 are mainly abraded by the rubbing, whereby the surface shape according to the present invention can be easily formed.

In addition, the load at which the strip-shaped abrasive is pressed against the developer bearing member at the abutting position is preferably set to 0.1 N or more and 0.5 N or less in order that the surface shape of the resin layer can be controlled.

The strip-shaped abrasive preferably has a width of 3 cm or more and 10 cm or less. When the strip-shaped abrasive having a width within the range is moved in the axial direction of the developer bearing member while being moved in the direction indicated by the arrow F, rubbing non-uniformity can be reduced, and the total sum of the areas of the protrusions of the resin layer in the present invention, and the arithmetic average surface roughness of the protrusions can be easily controlled. The speed at which the strip-shaped abrasive is moved in the axial direction is preferably set as appropriate depending on the strip-shaped abrasive to be used; when the speed is set to 5 mm/s or more and 60 mm/s or less, a desired surface shape can be easily obtained.

The speed at which the strip-shaped abrasive is moved in the direction indicated by the arrow F is preferably set to 5 mm/s or more and 60 mm/s or less. When the speed is set to fall within the range, a new surface of the strip-shaped abrasive and the developer bearing member appropriately rub against each other, so rubbing non-uniformity hardly occurs, and a desired surface shape can be easily obtained.

The rotational speed of the developer bearing member is preferably set as appropriate depending on the diameter of the developer bearing member to be used; when the rotating speed is set to 500 rpm or more and 2,000 rpm or less, rubbing non-uniformity hardly occurs, and a desired surface shape can be easily obtained.

A product obtained by applying and fixing abrasive particles made from, for example, aluminum oxide, silicon carbide, chromium oxide or diamond onto a film made from, for example, polyester can be used as the strip-shaped abrasive in the present invention. In addition, the abrasive particles preferably have an average primary particle diameter of 0.5 μm to 15.0 μm. Abrading the resin layer with abrasive particles having an average primary particle diameter within the above numerical value range makes it easy to control the arithmetic average roughness Ra(A) of the protrusions of the resin layer to 0.25 μm or more and 0.55 μm or less.

<<Substrate>>

The substrate of the developer bearing member used in the present invention is a cylindrical member, a columnar member, or a belt-like member. Of those, a cylindrical tube or solid rod made of a rigid body such as a metal is preferable because of its excellent processing accuracy and excellent durability. A product obtained by molding a nonmagnetic metal or alloy such as aluminum, stainless steel, or brass into a cylindrical shape or columnar shape and by subjecting the resultant to processing such as abrasion or grinding is suitably used as the substrate. Alternatively, a product obtained by forming a rubber layer or resin layer on the substrate may be used as the substrate of the present invention.

Such substrate is molded or processed with high accuracy and then used in order that the uniformity of an image may be improved. For example, the straightness of the substrate in its longitudinal direction is suitably 30 μm or less, preferably 20 μm or less, or more preferably 10 μm or less. In the case that a developer bearing member (sleeve) is rotated while being brought into contact with the photosensitive drum, and a uniform spacer is disposed therebetween, the fluctuation of a gap between the sleeve and a photosensitive drum is preferably 30 μm or less, more preferably 20 μm or less, or still more preferably 10 μm or less. Aluminum is preferably used for the substrate of the developer bearing member because of its material cost and ease of processing.

In addition, it is preferable for controlling the surface shape of the resin layer that the substrate used in the present invention preferably has an arithmetic average roughness Ra (reference length (lr)=4 mm) of 0.5 μm or less as measured on the basis of JIS(B0601-2001).

<Electrophotographic Image-Forming Apparatus and Electrophotographic Image-Forming Method>

Finally, an electrophotographic image-forming apparatus using the developing apparatus according to the present invention, and an electrophotographic image-forming method involving the use of the apparatus will be described with reference to FIG. 1.

The electrostatic latent image-bearing member 106 for bearing an electrostatic latent image such as the photosensitive drum 106 is rotated in the direction indicated by an arrow B. The developer bearing member 105 carries the developer (magnetic toner) 116 stored in the developer container 109 and having magnetic toner particles, and rotates in the direction indicated by an arrow A to convey the developer to the developing zone D where the developer bearing member 105 and the photosensitive drum 106 are opposite to each other. In the developer bearing member 105, a magnetic member (magnet roller) 104 is placed in a developing sleeve 103 in order that the developer can be magnetically attracted and held on the developer bearing member 105. The developing sleeve 103 is obtained by forming a resin layer 101 on a metal cylindrical tube as a substrate 102 to cover the tube.

The developer is fed into the developer container 109 from a developer-replenishing container (not shown) via a developer-supplying member 115 (such as a screw). The developer container 109 is divided into a first chamber 112 and a second chamber 111, and a stirring and conveying member 110 passes the developer fed into the first chamber 112 through a gap formed by the developer container 109 and a partitioning member 113 so that the developer can be fed into the second chamber 111. The developer bearing member 105 carries the developer on itself by virtue of the action of magnetic force from the magnet roller 104. A stirring member 114 for preventing the residence of the developer is provided in the second chamber 111.

When the developer includes magnetic toner particles, the friction between the magnetic toner particles and the friction between the developer and the resin layer 101 on the surface of the developer bearing member 105 provide triboelectric charges capable of developing an electrostatic latent image on the photosensitive drum 106. A magnetic blade (doctor blade) made of a ferromagnetic metal as the developer layer thickness-regulating member 107 is mounted in order that the layer thickness of the developer conveyed to the developing zone D can be regulated. The magnetic blade 107 is typically mounted on the developer container 109 so as to be opposite to the developer bearing member 105 with a gap of about 50 μm or more and 500 μm or less from the surface of the developer bearing member 105. Magnetic lines of force from a magnetic pole N1 of the magnet roller 104 converge on the magnetic blade 107, whereby a thin layer of the developer is formed on the developer bearing member 105. In the present invention, a nonmagnetic developer layer thickness-regulating member can also be used instead of the magnetic blade 107.

The thickness of the thin layer of the developer formed on the developer bearing member 105 is preferably smaller than the minimum gap between the developer bearing member 105 and the photosensitive drum 106 in the developing zone D.

In addition, a developing bias voltage is applied to the developer bearing member 105 from a developing bias power source 108 as a bias unit in order that the developer carried by the developer bearing member 105 can be flown. When a DC voltage is used as the developing bias voltage, a voltage intermediate between the electric potentials of the image portion (region to be visualized by the adhesion of the developer) and the background portion of the electrostatic latent image is preferably applied to the developer bearing member 105.

In order that the density and gradation of the developed image can be improved, an alternating bias voltage may be applied to the developer bearing member 105 so that a vibrating electric field the orientation of which is alternately inverted may be formed in the developing zone D. In this case, an alternating bias voltage on which a DC voltage component intermediate between the electric potential of the above-mentioned developed image portion and the electric potential of the background portion is superimposed is preferably applied to the developer bearing member 105.

EXAMPLES

Hereinafter, the present invention will be described by way of examples. However, the present invention is not limited to these examples. The terms "part(s)" and "%" in the following formulations represent "part(s) by mass" and "mass %", respectively unless otherwise stated.

Hereinafter, methods of measuring physical properties related to the present invention will be described.

<Developer>

(i) Saturation Magnetization of Developer (Magnetic Toner)

Measurement was performed with a vibrating sample magnetometer (trade name: VSM-P7; manufactured by TOEI INDUSTRY CO., LTD.) at a sample temperature of 25° C. in an external magnetic field of 795.8 kA/m.

(ii) Weight-Average Particle Diameter $D_4$ of Developer (Magnetic Toner)

A particle diameter measuring device (trade name: Coulter Multisizer III; manufactured by Beckman Coulter, Inc.) was used for measurement. About 1% aqueous solution of NaCl prepared by using sodium chloride (first class grade chemical) was used as an electrolyte. Approximately 0.5 ml of alkylbenzene sulfonate as a dispersant was added in about 100 ml of the electrolyte. Thereto, about 5 mg of a measurement sample were added and suspended. The electrolyte in which the sample was suspended was dispersed for about 1 minute by means of an ultrasonic dispersing device. After that, the volume and number of the measurement sample was measured by the use of a 100-μm aperture in the above measuring device, and volume distribution and number distribution were calculated. A weight average particle diameter ($D_4$) based on weight was determined from the volume distribution.

(iii) Ratio X of Amount of Fe(2+) to Total Amount Of Fe of Magnetic Iron Oxide Particles Dissolved Until Fe Element Dissolution Ratio Reaches 10 Mass %

25 g of magnetic iron oxide particles as a sample are added to 3.8 liters of deionized water, and the mixture is stirred at a stirring speed of 200 revolutions per minute while its temperature is kept at 40° C. in a water bath. 1,250 ml of a hydrochloric acid aqueous solution prepared by dissolving 424 ml of a hydrochloric acid reagent (special class grade chemical) (concentration: 35%) in deionized water is added to the resultant slurry to dissolve the magnetic iron oxide particles under stirring. During a time period beginning with the commencement of the dissolution and ending at the time point when the magnetic iron oxide particles are completely dissolved so that the mixture may become transparent, 50 ml of the hydrochloric acid aqueous solution are collected every 10 minutes together with the magnetic iron oxide particles dispersed in the aqueous solution. Immediately after that, the aqueous solution is filtrated with a 0.1-μm membrane filter, and the filtrate is collected. The amount of an Fe element is determined by using 25 ml of the collected filtrate with a plasma emission spectrometer ICP S2000 manufactured by Shimadzu Corporation. Then, the Fe element dissolution ratio (mass %) of the magnetic iron oxide particles is calculated from the following equation (6) for each collected sample.

Fe element dissolution ratio(mass %)={(iron element concentration(mg/l)in collected sample)/(iron element concentration(mg/l)at time of complete dissolution)}×100 Eq. (6)

In addition, an Fe(2+) concentration is measured by using 25 ml of the remaining collected filtrate. A sample is prepared by adding 75 ml of deionized water to the 25 ml filtrate, and sodium diphenylamine sulfonate is added as an indicator to the sample. Then, the sample is subjected to oxidation-reduction titration with a 0.05 mol/l potassium dichromate aqueous solution, and a point of time that the sample is colored violet is defied as an endpoint to determine a titer. The Fe(2+) concentration (mg/l) is calculated from the titer.

A ratio of the amount of Fe(2+) at the time point when each sample is collected is calculated from the following equation (7) by using the iron element concentration in the sample determined by the above-mentioned method and the Fe(2+) concentration determined from the sample at the same time point.

Ratio of amount of Fe(2+)(%)={(Fe(2+)concentration (mg/l)in collected sample)/(iron element concentration(mg/l)in collected sample)}×100 Eq. (7)

Then, the Fe element dissolution ratio and the ratio of the amount of Fe(2+) thus obtained are plotted for each collected sample, and an "Fe element dissolution ratio-versus-ratio of amount of Fe(2+)" graph is created by smoothly connecting the respective points. The ratio X (%) of the amount of Fe(2+) to the total amount of Fe dissolved until the Fe element dissolution ratio reaches 10 mass % is determined by using the graph.

(iv) Calculation of Ratio (X/Y) Between Fe(2+) Contents

The ratio X (%) is determined by the above-mentioned method.

The ratio Y (%) of the amount of Fe(2+) to the total amount of Fe in the remaining 90 mass % excluding the amount of Fe dissolved until the Fe element dissolution ratio reaches 10 mass % is calculated by the following method.

That is, the difference between the iron element concentration (mg/l) when the magnetic iron oxide particles are completely dissolved and the iron element concentration (mg/l) when the Fe element dissolution ratio is 10 mass % obtained in the above-mentioned measurement of the X is defined as an iron element concentration (mg/l) in the remaining 90 mass %.

The difference between the Fe(2+) concentration (mg/l) when the magnetic iron oxide particles are completely dissolved and the Fe(2+) concentration (mg/l) when the Fe element dissolution ratio is 10 mass % obtained in the above-mentioned measurement of the X is defined as an Fe(2+) concentration (mg/l) in the remaining 90 mass %. Using the values thus obtained, the ratio Y (%) of the amount of Fe(2+) to the total amount of Fe in the remaining 90 mass % excluding the amount of Fe dissolved until the Fe element dissolution ratio reaches 10 mass % is calculated from the following equation (8).

Y(%)={(Fe(2+)concentration at time of complete dissolution−Fe(2+)concentration when iron element dissolution ratio is 10 mass %)/(iron element concentration at time of complete dissolution−iron element concentration when iron element dissolution ratio is 10 mass %)}×100 Eq. (8)

The ratio (X/Y) is calculated by using the ratios X (%) and Y (%) calculated as described above.

(v) Determination of Total Content of Dissimilar Elements (Such as Silicon) of Magnetic Iron Oxide Particles 26 ml of a hydrochloric acid aqueous solution in which 16 ml of a hydrochloric acid reagent (special class grade chemical) (concentration: 35%) has been dissolved is added to 1.00 g of a sample to dissolve the sample under heat (at 80° C. or lower). After that, the solution is left standing to cool to room temperature. 4 ml of a hydrofluoric acid aqueous solution in which 2 ml of a hydrofluoric acid reagent (special class grade chemical) (concentration: 4%) has been dissolved is added to the solution, and then the mixture is left standing for 20 minutes. 10 ml of a Triton X-100 (concentration: 10%) (manufactured by ACROS ORGANICS) is added to the mixture, and then the resultant mixture is transferred to a 100-ml measuring flask. Pure water is added to the mixture so that the volume of the entire solution is adjusted to 100 ml.

The content of dissimilar elements (such as silicon) in the solution reagent is determined with a plasma emission spectrometer ICP S2000 manufactured by Shimadzu Corporation.

(vi) Determination of Content of Dissimilar Elements (Such as Silicon and Aluminum) in Coating Layers 0.900 g of a sample is weighed, and 25 ml of a 1 mol/l NaOH solution are added to the sample. The temperature of the resultant liquid is increased to 45° C. while the liquid is stirred. Thus, dissimilar elements (such as a silicon component and an aluminum component) on the surfaces of the magnetic iron oxide particles are dissolved. After undissolved matter has been separated by filtration, pure water is added to an eluate so that the volume of the mixture is 125 ml. Then, the amounts of silicon and aluminum in the eluate are determined with the above plasma emission spectrometer (ICP). The content of the dissimilar elements (such as a silicon component and an aluminum component) in the coating layers is calculated by using the following equation (9).

Content of dissimilar element components in coating layers(%)={(dissimilar element concentration(g/l)in eluate×125÷1,000)/0.900(g)}×100 Eq. (9)

(vii) Determination of Content of Dissimilar Elements (Such as Silicon) in Core Particles The difference between the total content of the dissimilar elements described in the above section (v) and the content of the dissimilar elements in the coating layers described in the above section (vi) was defined as the content of the dissimilar elements in the core particles.

(viii) Measurement of Number-Average Primary Particle Diameter of Magnetic Iron Oxide Particles The magnetic iron oxide particles are observed with a scanning electron microscope (at a magnification of 40,000). The Feret diameters of 200 particles are measured, and the number-average particle diameter of the particles is determined. In this example, an S-4700 (manufactured by Hitachi, Ltd.) was used as the scanning electron microscope.

(ix) Measurement of Softening Point of Binder Resin

The softening point of the binder resin is measured with a flowability-evaluating apparatus (trade name: Flow Tester CFT-500D; manufactured by Shimadzu Corporation) in adherence to the measurement method described in JIS K 7210. A specific measurement method is as described below. While a sample having a volume of 1 $cm^3$ is heated with the above flowability-evaluating apparatus at a temperature rise rate of 6° C./min, a load of 1,960 $N/m^2$ (20 $kg/cm^2$) is applied to the sample by means of a plunger so that the sample may be extruded from a nozzle having a diameter of 1 mm and a length of 1 mm. A plunger falling quantity (flow value)– temperature curve in this case is created. The height of the curve is represented by h, and the temperature corresponding to h/2 (the temperature at which half of the resin flows out) is defined as the softening point.

(x) Measurement of Molecular Weight Distribution by Means of GPC

A column is stabilized in a heat chamber at a temperature of 40° C. THF as a solvent is allowed to flow into the column at the temperature at a flow rate of 1 ml/min. After that, about 100 μl of a THF sample solution are injected to perform measurement. When the molecular weight of the sample is measured, the molecular weight distribution of the sample is calculated from the relationship between a logarithmic value of a calibration curve prepared by means of several kinds of monodisperse polystyrene standard samples and the number of counts. The standard polystyrene samples used for preparing a calibration curve have, for example, a molecular weight of about $10^2$ or more and $10^7$ or less, and at least about ten of the standard polystyrene samples are preferably used.

Examples of the standard polystyrene samples include the following: TSK standard polystyrene (trade name; manufactured by Tosoh Corporation), for example, Type F-850, F-450, F-288, F-128, F-80, F-40, F-20, F-10, F-4, F-2, F-1, A-5000, A-2500, A-1000, and A-500.

In addition, a refractive index (RI) detector is used as a detector. It is recommended that a plurality of commercially available polystyrene gel columns be combined to be used as the column. Examples of the commercially available polystyrene gel, columns include the following: Shodex GPC KF-801, 802, 803, 804, 805, 806, 807, and 800P (trade names; manufactured by Showa Denko K.K.); and TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSK guard column (trade names; manufactured by Tosoh Corporation).

The sample solution is adjusted so that the concentration of components soluble in THF is about 0.8 mass %, and the whole is left to stand for several hours at a temperature of 25° C. After that, the resultant is sufficiently shaken so that the sample is mixed well with THF (until agglomerates of the sample disappears), and the resultant is left standing for an additional 12 hours or longer. In this case, the period for which the sample is left standing in THF should be 24 hours. After that, the resultant is allowed to pass through a sample treating filer (pore size: approximately 0.5 μm; for example, Myshori Disk H-25-2 (manufactured by Tosoh Corporation) can be used) to be used as a sample for GPC. In addition, the sample concentration is adjusted in such a manner that the concentration of a resin component is 5 mg/ml.

(xi) Measurement of Glass Transition Temperature of Binder Resin

Measurement is performed by using a differential scanning calorimeter (DSC) (trade name: MDSC-2920; manufactured by TA Instruments) in conformity with ASTM D3418-82 at normal temperature and normal humidity.

2 mg or more and 10 mg or less, or preferably about 3 mg, of a measurement sample are precisely weighed and used. The sample is placed in an aluminum pan. An empty aluminum pan is used as a reference. The measurement is performed in the measurement temperature range of 30° C. or higher to 200° C. or lower as follows: the temperature of the measurement sample is raised once from 30° C. to 200° C. at a temperature rise rate of 10° C./min, is then lowered from 200° C. to 30° C. at a temperature drop rate of 10° C./min, and is raised again to 200° C. at a temperature rise rate of 10° C./min. The intersection of the middle line between base lines before and after the appearance of a change in specific heat in the DSC curve obtained during the course of the second temperature rise and the differential thermal curve is defined as the glass transition temperature Tg of a binder resin.

(xii) Measurement of Content of THF Insoluble Matter 1.0 g of the binder resin is weighed (the amount is represented by "W1" g). The weighed resin is placed in extraction thimble (such as No. 86R manufactured by Toyo Roshi), and is set in a Soxhlet extractor so that the resin may be subjected to Soxhlet extraction with 200 ml of THF for 20 hours. After that, the extracted component is dried in vacuum at a temperature of 40° C. for 20 hours, and is then weighed (the amount is represented by "W2" g). The content of THF insoluble matter is calculated in accordance with the following equation (10).

$$\text{Content of } THF \text{ insoluble matter(mass \%)} = [(W1 - W2)/W1] \times 100 \quad \text{Eq. (10)}$$

<Developer Bearing Member>

(xiii) Measurement of Surface Shape of Resin Layer With Confocal Optical Laser Microscope The surface shape of a resin layer was measured with an apparatus prepared by connecting a measuring part "VK-8710" (KEYENCE CORPORATION; trade name), a controller "VK-8700", and a control personal computer. Further, the surface shape of the resin layer was analyzed with observation application software (trade name: VK-H1V1; manufactured by KEYENCE CORPORATION) and shape analysis application software (trade name: VK-H1A1; manufactured by KEYENCE CORPORATION).

A developer bearing member was mounted on the stage of the measuring part, and focusing was performed by controlling the height of the stage. The magnification of an objective lens in this case was 20. In addition, the developer bearing member used in the measurement has a cylindrical shape, so the stage was controlled so that the apex of an arc is set to be a measurement position. Whether the objective lens was in focus was confirmed on the observation application software.

Next, a measurement range in the Z-axis direction on the observation application software was defined by adjusting a lens position. The lens position was moved upward, and the lens was placed at such a position (height) as to be out of focus in an entire observation region. The lens position in this case was set as a measurement upper limit in the Z-axis direction. The lens was similarly moved downward, and the position (height) at which the lens was out of focus in the entire observation region was set as a measurement lower limit in the Z-axis direction. After the upper and lower limits was set, a measurement pitch in the Z-axis direction was set to 0.1 μm, and height data (three-dimensional data) on 1,024×768 pixels (706.56 μm×529.92 μm) was acquired. If there was in the acquired height data a pixel whose measured value was 0, the resin layer was not correctly measured, so measurement was performed again by moving the measurement lower limit further downward. Similarly, when a pixel whose measured value was equal to a width between the measurement upper and lower limits was present, measurement was performed again by moving the measurement upper limit further upward.

The acquired three-dimensional data was analyzed on the shape analysis application software. First, a filtration treatment and gradient corrections were performed in order that noise at the time of measurement could be removed. The filtration treatment was performed by smoothing the data through simple average with 5×5 pixels as a unit. A surface gradient correction and a quadric surface correction were performed as the gradient corrections. The surface gradient correction was performed by: determining an approximate plane by a least-squares method on the basis of the height data on the entire region; and correcting the gradient so that the determined approximate plane was horizontal. The quadric surface correction was performed by: determining an approximate curved surface by a least-squares method on the basis of the height data on the entire region; and correcting the gradient so that the determined approximate curved surface was horizontal.

The three-dimensional heights of the surface of the developer bearing member in the present invention were measured for a square region 0.50 mm in side on the surface of the developer bearing member one side of which is parallel to the direction in which the developer bearing member rotates at intersections (725×725=525,625 points) of 725 straight lines parallel to one side of the square region and 725 straight lines intersecting at right angles with the straight lines when the square region is equally divided by the straight lines. Then, the average (H) of the heights is an average determined from data obtained by removing noise from those measured values.

In addition, the total sum of the areas of protrusions having a height in excess of $H+(D_4/4)$ at a height of $H+(D_4/4)$ was measured from the three-dimensional data from which noise had been removed with the volume/area program of the shape analysis application software. First, a region to be measured was designated from the observation region. The designated region was 0.50 mm×0.50 mm, and the center of the observation region was set to be a basis. Next, the value "$H+(D_4/4)$" was input as a lower limit height, and the total area of sectional regions corresponding to a height of $H+(D_4/4)$ was calculated by subtracting surface areas excluding areas at the upper and lower limits from surface areas including the areas at the upper and lower limits.

Arithmetic average roughness was measured from the three-dimensional data from which noise had been removed with the surface roughness program of the shape analysis application software. A region to be measured was designated from the observation region. The designated region was 0.50 mm×0.50 mm, and the center of the observation region was set to be a basis. The arithmetic average roughness Ra is defined by the following equation (11).

$$Ra = \frac{1}{N}\sum_{n=1}^{N}|Zn| \qquad \text{Eq. (11)}$$

(Zn represents a value "the height of each point−the height of a reference surface", and N represents the number of pixels (725×725) of the designated region. A plane at a height obtained by averaging all data on 725×725 pixels of the designated region was defined as the reference surface.)

Values with no cutoff were defined as measured values because the results of measurement in the case where a cutoff value (λc=0.8 mm) defined in JIS B 0601-2001 was used were nearly identical to those in the case where the cutoff value was not used.

Similarly, roughness was measured at 100 points (10 points in the circumferential direction of the developer bearing member for each of 10 points in the axial direction of the developer bearing member), and the average of the measured values was defined as the arithmetic average roughness Ra determined from the surface shape of the resin layer. The Ra(A) was determined by inputting the value "$H+(D_{4/4})$" as a lower threshold value, and the Ra(B) was determined by inputting the value "$H+(D_4/4)$" as an upper threshold value. When a threshold value is input, the above arithmetic average roughness is measured only with pixels selected according to the threshold value. The measured values were analyzed with the three-dimensional data from which noise had been removed, and a method of designating a region to be analyzed and a method of measuring the arithmetic average roughness were identical to those described above. Similarly, roughness was measured at 100 points (10 points in the circumferential direction of the developer bearing member for each of 10 points in the axial direction of the developer bearing member), and the average of the measured values was defined as the arithmetic average roughness Ra(A) or Ra(B) determined from the surface shape of the resin layer.

(xiv) Universal Hardness of Resin Layer

The universal hardness HU of the surface of the resin layer were measured by surface film physical property test with a Fischerscope H100V (trade name) manufactured by Fischer Instruments KK in conformity with ISO/FDIS14577. A pyramidal diamond indenter having an angle between the opposite faces of 136° was used in the measurement. The indenter is pushed into a measurement sample while a measuring load F (unit: N) is applied in stages, and an indentation depth h (unit: mm) is measured in a state in which a load is applied. Universal hardness HU is determined by substituting a measured value for h in the following equation (12).

$$HU=K\times F/h^2[N/\mathrm{mm}^2] \qquad \text{Eq. (12)}$$

where K represents a constant having a value of 1/26.43.

A sample obtained by forming the resin layer on the surface of a substrate is used for measurement; the sample for measurement is preferably subjected to smoothing treatment such as abrading treatment before the measurement because the surface of the resin layer is desirably smooth in order that measurement accuracy may be improved. Therefore, in the present invention, before the measurement, the surface of the resin layer was subjected to abrading treatment with Wrapping Film Sheet #2000 (trade name, Sumitomo 3M Limited, using aluminum oxide particles having an average primary particle diameter of 9 μm as abrasive particles) so that the surface roughness Ra after the abrading treatment was adjusted to 0.2 μm or less.

The test load F and the maximum indentation depth h of the indenter each preferably fall within such a range as to be affected neither by the surface roughness of the surface of the resin layer nor by the substrate as a base. Taking the foregoing into account, in the present invention, the measurement was performed by applying the test load F so that the maximum indentation depth h of the indenter was about 1 μm to 2 μm. The measurement was performed 100 times at different measurement points in an environment having a temperature of 23° C. and a humidity of 50%, and the average determined from the measured values was defined as the universal hardness U of the resin layer.

(xv) Volume-Average Particle Diameter of Conductive, Spherical Carbon Particles

A laser diffraction type grain size distribution meter (trade name: Coulter LS-230 grain size distribution meter; manufactured by Beckman Coulter, Inc) was used as an apparatus for measuring the particle diameters of conductive, spherical carbon particles. In measurement, a small amount module was used, and isopropyl alcohol (IPA) was used as a measurement solvent. First, the inside of the measuring system of the measuring apparatus was washed with IPA for about 5 minutes, and a background function was performed after the washing. Next, about 10 mg of a measurement sample were added to 50 ml of IPA. A solution in which the sample had been suspended was subjected to dispersion treatment with an ultrasonic dispersing machine for about 2 minutes so that a sample solution was prepared. After that, the sample solution was gradually added into the measuring system of the measuring apparatus, and the sample concentration in the measuring system was adjusted so that PIDS on the screen of the apparatus was 45% to 55%. After that, the measurement was performed, and a volume-average particle diameter was determined from the volume distribution.

(xvi) Graphitization Degree of Graphitized Particles

A degree of graphitization p(002) is determined from the following equation (13) by measuring a grating space d(002) obtained from the X-ray diffraction spectrum of graphite with a strong, fully automatic X-ray diffractometer "MXP18" system (trade name) manufactured by MacScience.

$$d(002)=3.440-0.086[1-p(002)2] \quad \text{Eq. (13)}$$

In measuring the grating space d(002), CuKα is used as an X-ray source, and CuKβ rays are removed with a nickel filter. High-purity silicon is used as a standard substance, and the grating space d(002) is calculated from the peak positions of C(002) and Si(111) diffraction patterns. Main measurement conditions are as described below.

X-ray generator: 18 kw
Goniometer: horizontal goniometer
Monochromater: used
Tube voltage: 30.0 kV
Tube current: 10.0 mA
Measurement method: continuous method
Scan axis: 2 θ/θ
Sampling interval: 0.020 deg
Scan speed: 6.000 deg/min
Divergence slit: 0.50 deg
Scattering slit: 0.50 deg
Light-receiving slit: 0.30 mm (xvii) Arithmetic Average Particle Diameter of Graphitized Particles Determined from Section of Resin Layer A developer bearing member was cut on the surface perpendicular to the axial direction of the developer bearing member every 20 nm with a focused ion beam (trade name: FB-2000C; manufactured by Hitachi, Ltd.). Each of the cut sections was photographed with an electron microscope (trade name: H-7500; manufactured by Hitachi, Ltd.). When the sum of the measured values of the major and minor diameters of each particle in an image on a plurality of photographs became maximal, such measured values were defined as the shape of the particle, and the particle diameters of 100 graphitized particles were measured. The average of the measured major diameter and minor diameter of each of the particles was defined as the particle diameter of the particle. An arithmetic average particle diameter was determined from the respective particle diameters. The measurement magnification was 100,000.

(1) Production of Developer (Magnetic Toner)

<Production Example of Binder Resin a-1>

The following components as monomers for producing a polyester unit and tin 2-ethylhexanoate as a catalyst were placed in a four-necked flask.

| | |
|---|---|
| Terephthalic acid | 25 mol % |
| Dodecenylsuccinic acid | 15 mol % |
| Trimellitic anhydride | 7 mol % |
| Bisphenol derivative represented by the formula (I-1) (2.5-mol adduct of propylene oxide) | 32 mol % |
| Bisphenol derivative represented by the formula (I-1) (2.5-mol adduct of ethylene oxide) | 22 mol % |

The four-necked flask was provided with a decompression device, a water-separating device, a nitrogen gas-introducing device, a temperature-measuring device, and a stirring device, and the mixture was stirred under a nitrogen atmosphere at a temperature of 130° C. During the stirring, a mixture of 25 parts by mass of monomer components having the following composition for producing a styrene-type copolymer resin unit with respect to 100 parts by mass of the above monomer components and a polymerization initiator (benzoyl peroxide) was added dropwise from a dropping funnel into the four-necked flask over 4 hours.

| | |
|---|---|
| Styrene | 83 mass % |
| 2-ethylhexyl acrylate | 15 mass % |
| Acrylic acid | 2 mass % |

The above materials were aged for 3 hours while being held at a temperature of 130° C., and then the temperature was raised to 230° C. so that the materials were allowed to react with one another. After the completion of the reaction, the product was taken out of the container and pulverized, whereby a binder resin a-1 containing a polyester resin component, a styrene-type copolymer resin component, and a hybrid resin component was obtained. Table 1 shows the physical properties of the binder resin a-1.

<Production Example of Binder Resin a-2>

The following components as monomers for producing a polyester unit and tin 2-ethylhexanoate as a catalyst were placed in a four-necked flask.

| | |
|---|---|
| Terephthalic acid | 27 mol % |
| Dodecenylsuccinic acid | 13 mol % |
| Trimellitic anhydride | 2 mol % |
| Bisphenol derivative represented by the formula (I-1) (2.5-mol adduct of propylene oxide) | 32 mol % |
| Bisphenol derivative represented by the formula (I-1) (2.5-mol adduct of ethylene oxide) | 26 mol % |

The four-necked flask was provided with a decompression device, a water-separating device, a nitrogen gas-introducing device, a temperature-measuring device, and a stirring device, and the mixture was stirred under a nitrogen atmosphere at a temperature of 130° C. During the stirring, a mixture of 25 parts by mass of monomer components having the following composition for producing a styrene-type copolymer resin unit with respect to 100 parts by mass of the above monomer components and a polymerization initiator (benzoyl peroxide) was added dropwise from a dropping funnel into the four-necked flask over 4 hours.

| | |
|---|---|
| Styrene | 83 mass % |
| 2-ethylhexyl acrylate | 15 mass % |
| Acrylic acid | 2 mass % |

The above materials were aged for 3 hours while being held at a temperature of 130° C., and then the temperature was increased to 230° C. so that the materials were allowed to react with one another. After the completion of the reaction, the product was taken out of the container and pulverized, whereby a binder resin a-2 containing a polyester resin component, a styrene-type copolymer resin component, and a hybrid resin component was obtained. Table 1 shows the physical properties of the binder resin a-2.

TABLE 1

| Binder resin | Softening point (° C.) | Mw | Mw/Mn | THF insoluble matter | Tg (° C.) |
|---|---|---|---|---|---|
| a-1 | 132 | 60,000 | 8.4 | 34% | 57.4 |
| a-2 | 94 | 8,400 | 2.4 | 0% | 57.9 |

<Production Example of Magnetic Iron Oxide>Particles b-1

50 L of an aqueous solution of ferrous sulfate containing 2.0 mol/L of $Fe^{2+}$ were prepared by using ferrous sulfate. In addition, 10 L of an aqueous solution of sodium silicate containing 0.23 mol/L of $Si^{4+}$ was prepared by using sodium silicate, and was then added to and mixed in the aqueous solution of ferrous sulfate. Next, 42 L of a 5.0-mol/L NaOH aqueous solution was mixed in the mixed aqueous solution under stirring, whereby ferrous hydroxide slurry was obtained. The pH and temperature of the ferrous hydroxide slurry were adjusted to 12.0 and 90° C., respectively, and an oxidation reaction was performed by blowing air into the slurry at 30 L/min until 50% of ferrous hydroxide was turned into magnetic iron oxide particles. Next, air was blown into the slurry at 20 L/min until 75% of ferrous hydroxide was turned into magnetic iron oxide particles. Next, air was blown into the slurry at 9 L/min until 90% of ferrous hydroxide was turned into magnetic iron oxide particles. Further, the oxidation reaction was completed by blowing air into the slurry at 6 L/min at the time point when a ratio of magnetic iron oxide particles exceeded 90%. Thus, slurry containing core particles of an octahedral shape was obtained.

0.094 L of an aqueous solution of sodium silicate (containing 13.4 mass % of Si) and 0.288 L of an aqueous solution of aluminum sulfate (containing 4.2 mass % of Al) were simultaneously charged into the resultant slurry containing the core particles. After that, the temperature of the slurry was adjusted to 80° C., and the pH of the slurry was adjusted to 5 or more and 9 or less with diluted sulfuric acid, whereby a coating layer containing silicon and aluminum was formed on the surface of each of the core particles. The resultant magnetic iron oxide particles were filtrated by an ordinary method, and were then dried and pulverized, whereby magnetic iron oxide particles b-1 were obtained. Table 3 shows the physical properties of the magnetic iron oxide particles b-1.

<Production Examples of Magnetic Iron Oxide Particles b-2 to b-6>

Magnetic iron oxide particles b-2 to b-6 were each obtained in the same manner as in the production example of the magnetic iron oxide particles b-1 except that production conditions were adjusted as shown in Table 2. Table 3 shows the physical property values of the resultant magnetic iron oxide particles b-2 to b-6.

The respective stages in the "flow rate at which air is blown" in Table 2 represent the following states.

First stage: the production ratio of the magnetic iron oxide particles is 0% or more and 50% or less.

Second stage: the production ratio of the magnetic iron oxide particles is more than 50% and 75% or less.

Third stage: the production ratio of the magnetic iron oxide particles is more than 75% and 90% or less.

Fourth stage: the production ratio of the magnetic iron oxide particles is more than 90% and up to 100%.

<Production Example of Magnetic Iron Oxide Particles b-7>

Magnetic iron oxide particles b-7 were obtained in the same manner as in the production example of the magnetic iron oxide particles b-1 except that: the pH of the ferrous hydroxide slurry was adjusted to 11.5; and the oxidation reaction was not performed in stages, but was completed at 90° C. and 30 L/min. Table 3 shows the physical property values of the resultant magnetic iron oxide particles b-7.

TABLE 2

| | Core particle reaction | | | | | | | | Coating treatment | |
|---|---|---|---|---|---|---|---|---|---|---|
| | Solution of water-soluble silicate | | Flow rate at which air is blown (L/min) | | | | | | Aqueous solution of sodium silicate | Aqueous solution of aluminum sulfate |
| Magnetic iron oxide particles | Concentration (mol/L) | Liquid amount (L) | First stage | Second stage | Third stage | Fourth stage | Liquid temperature (° C.) | Reaction pH | Liquid amount (L) | Liquid amount (L) |
| b-1 | 0.23 | 10 | 30 | 20 | 9 | 6 | 90 | 12.0 | 0.094 | 0.288 |
| b-2 | 0.30 | 10 | 20 | 12 | 7 | 3 | 90 | 12.5 | 0.094 | 0.288 |
| b-3 | 0.25 | 10 | 30 | 20 | 12 | 6 | 90 | 11.5 | 0.094 | 0.288 |
| b-4 | 0.28 | 10 | 30 | 20 | 9 | 6 | 90 | 13.0 | 0.094 | 0.288 |
| b-5 | 0.23 | 10 | 20 | 13 | 4 | 3 | 90 | 12.5 | 0.094 | 0.288 |
| b-6 | 0.47 | 10 | 10 | 6 | 5 | 3 | 90 | 13.5 | 0.094 | 0.288 |
| b-7 | 0.23 | 10 | 30 | 30 | 30 | 30 | 90 | 11.5 | 0.094 | 0.288 |

TABLE 3

| Magnetic iron oxide particles | Particle shape | SEM average particle diameter (μm) | Ratio of amount of Fe(2+) when Fe dissolution ratio is 10% (%) | Ratio of amount of Fe(2+) in surface 10% to amount of Fe(2+) in inside 90% X/Y | Magnetization ($Am^2/kg$) in magnetic field of 795.8 kA/m | Core particles Silicon content (%) | Coating layer Silicon content (%) | Coating layer Aluminum content (%) |
|---|---|---|---|---|---|---|---|---|
| b-1 | Octahedral | 0.15 | 36 | 1.15 | 89.2 | 0.73 | 0.19 | 0.18 |
| b-2 | Octahedral | 0.21 | 45 | 1.29 | 86.3 | 0.76 | 0.20 | 0.19 |
| b-3 | Octahedral | 0.11 | 34 | 0.97 | 87.9 | 0.72 | 0.18 | 0.20 |
| b-4 | Octahedral | 0.30 | 38 | 1.01 | 87.0 | 0.78 | 0.21 | 0.20 |
| b-5 | Octahedral | 0.27 | 46 | 1.36 | 89.3 | 0.70 | 0.17 | 0.17 |
| b-6 | Octahedral | 0.34 | 49 | 1.05 | 85.1 | 0.81 | 0.16 | 0.15 |
| b-7 | Octahedral | 0.38 | 27 | 0.96 | 88.2 | 0.75 | 0.18 | 0.19 |

<Production Example of Developer c-1>

The following materials were premixed by means of a Henschel mixer. After that, the mixture was melted and kneaded with a biaxial kneading extruder. In this case, a residence time was controlled so that the temperature of the kneaded resin was 150° C.

| | |
|---|---|
| Binder resin a-1 | 90 parts by mass |
| Binder resin a-2 | 10 parts by mass |
| Magnetic iron oxide particles b-1 | 65 parts by mass |
| Wax [Fischer-Tropsch wax (having a highest endothermic peak temperature of 105° C., a number-average molecular weight of 1,500, and a weight-average molecular weight of 2,500)] | 4 parts by mass |
| Charge control agent having a structure represented by the following structural formula (14) (negatively chargeable charge control agent) | 2 parts by mass |

Structural formula (14)

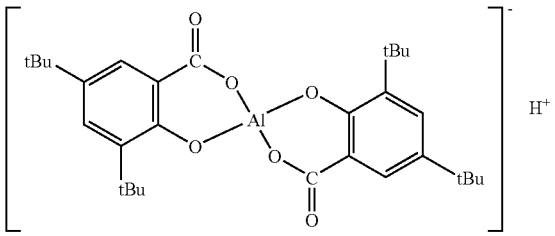

The resultant kneaded product was cooled and coarsely pulverized with a hammer mill. After that, the coarsely pulverized product was pulverized with a turbo mill, and the resultant finely pulverized powder was classified with a multi-division classifier utilizing Coanda effect, whereby negatively chargeable, magnetic toner particles having a weight-average particle diameter ($D_4$) of 6.1 μm were obtained. The following substances were externally added to and mixed with 100 parts by mass of the resultant magnetic toner particles, and the mixture was sieved with a mesh having an aperture of 150 μm, whereby a negatively chargeable developer c-1 was obtained. Table 4 shows the constitution and physical properties of the developer c-1.

| | |
|---|---|
| Hydrophobic silica fine powder (having a BET specific surface area of 140 $m^2/g$ and subjected to hydrophobic treatment with 30 parts by mass of hexamethyldisilazane (HMDS) and 10 parts by mass of dimethyl silicone oil with respect to 100 parts by mass of a silica parent body) | 1.0 part by mass |
| Strontium titanate (having a number-average particle diameter of 1.2 μm): | 3.0 parts by mass |

<Production Examples of Developers c-2 to c-17>

Developers c-2 to c-17 were each obtained in the same manner as in Example 1 except that the formulation shown in Table 4 was adopted. Table 4 shows the constitution and physical properties of each of the developers c-2 to c-17.

TABLE 4

| Developer No. | Resin a-1 Addition amount (parts) | Resin a-2 Addition amount (parts) | Magnetic iron oxide particles | Addition amount (parts) | Addition amount of wax (parts) | Addition amount of charge control agent (parts) | Saturation magnetization ($Am^2/kg$) | Particle diameter (μm) |
|---|---|---|---|---|---|---|---|---|
| c-1 | 90 | 10 | b-1 | 65 | 4 | 2 | 33.05 | 6.1 |
| c-2 | 90 | 10 | b-1 | 65 | 4 | 2 | 33.02 | 4.1 |
| c-3 | 90 | 10 | b-1 | 65 | 4 | 2 | 33.12 | 8.0 |
| c-4 | 90 | 10 | b-2 | 16 | 4 | 2 | 20.22 | 6.2 |
| c-5 | 90 | 10 | b-4 | 95 | 4 | 2 | 39.85 | 6.0 |
| c-6 | 90 | 10 | b-3 | 65 | 4 | 2 | 33.01 | 6.1 |
| c-7 | 90 | 10 | b-6 | 65 | 4 | 2 | 32.99 | 5.9 |
| c-8 | 90 | 10 | b-3 | 16 | 4 | 2 | 20.05 | 4.0 |
| c-9 | 90 | 10 | b-6 | 95 | 4 | 2 | 39.92 | 7.9 |
| c-10 | 90 | 10 | b-4 | 65 | 4 | 2 | 33.03 | 6.0 |
| c-11 | 90 | 10 | b-2 | 65 | 4 | 2 | 33.02 | 6.1 |
| c-12 | 90 | 10 | b-5 | 65 | 4 | 2 | 33.09 | 6.1 |

TABLE 4-continued

| Developer No. | Resin a-1 Addition amount (parts) | Resin a-2 Addition amount (parts) | Addition Magnetic iron oxide particles | Addition amount (parts) | Addition amount of wax (parts) | Addition amount of charge control agent (parts) | Saturation magnetization ($Am^2/kg$) | Particle diameter (μm) |
|---|---|---|---|---|---|---|---|---|
| c-13 | 90 | 10 | b-1 | 14 | 4 | 2 | 19.45 | 6.0 |
| c-14 | 90 | 10 | b-1 | 98 | 4 | 2 | 40.52 | 6.2 |
| c-15 | 90 | 10 | b-7 | 65 | 4 | 2 | 33.07 | 6.1 |
| c-16 | 90 | 10 | b-1 | 65 | 4 | 2 | 33.01 | 3.8 |
| c-17 | 90 | 10 | b-1 | 65 | 4 | 2 | 33.14 | 8.2 |

<(2) Production of Developer Bearing Member

<Graphitized Particles>

<<Production Example of Graphitized Particles d-1>>

β-resin was extracted from coal tar pitch by solvent fractionation, and was subjected to hydrogenation and heavy treatment. After that, solvent soluble matter was removed with toluene, whereby mesophase pitch was obtained. The bulk mesophase pitch was finely pulverized, and the finely pulverized product was subjected to oxidation treatment in air at about 300° C. After that, the oxidized product was subjected to heat treatment under a nitrogen atmosphere at a calcining temperature of 3,000° C., and was further classified, whereby graphitized particles d-1 were obtained. Table 5 shows the physical properties of the graphitized particles d-1.

<<Production Example of Graphitized Particles d-2>>

Mesocarbon microbeads obtained by subjecting coal-type heavy oil to heat treatment were washed and dried. After that, the microbeads were mechanically dispersed by means of an atomizer mill, and were subjected to primary heating treatment under a nitrogen atmosphere at 1,200° C. so as to be carbonized. Next, the carbonized microbeads were subjected to secondary dispersion with an atomizer mill. After that, the microbeads were subjected to heat treatment under a nitrogen atmosphere at a calcining temperature of 3,100° C., and were further classified, whereby graphitized particles d-2 were obtained. Table 5 shows the physical properties of the graphitized particles d-2.

<<Production Examples of Graphitized Particles d-3 to d-7>>

Graphitized particles d-3 to d-7 were each obtained in the same manner as in the production example of the graphitized particles d-1 or d-2 except that a raw material for the graphitized particles and a burning temperature were adjusted as shown in Table 5. Table 5 shows the physical property values of the resultant graphitized particles d-3 to d-7.

TABLE 5

| Graphitized particles | Raw material | Calcining temperature (° C.) | Particle diameter (μm) | Degree of graphitization |
|---|---|---|---|---|
| d-1 | Bulk mesophase pitch | 3,000 | 3.5 | 0.37 |
| d-2 | Mesocarbon microbeads | 3,100 | 4.2 | 0.22 |
| d-3 | Bulk mesophase pitch | 2,300 | 3.5 | 0.75 |
| d-4 | Mesocarbon microbeads | 2,700 | 5.0 | 0.45 |
| d-5 | Bulk mesophase pitch | 2,600 | 1.1 | 0.63 |

TABLE 5-continued

| Graphitized particles | Raw material | Calcining temperature (° C.) | Particle diameter (μm) | Degree of graphitization |
|---|---|---|---|---|
| d-6 | Bulk mesophase pitch | 3,500 | 3.7 | 0.17 |
| d-7 | Bulk mesophase pitch | 2,200 | 3.4 | 0.80 |

<Conductive, Spherical Carbon Particles>

The following products were used as conductive, spherical carbon particles.

e-1:

Products obtained by classifying NICABEADS PC-0520 (trade name; Nippon Carbon Co., Ltd.) were used (volume-average particle diameter=5.9 μm).

e-2:

Products obtained by classifying NICABEADS PC-0520 (trade name; Nippon Carbon Co., Ltd.) were used (volume-average particle diameter=4.1 μm).

e-3:

Products obtained by classifying NICABEADS PC-0520 (trade name; Nippon Carbon Co., Ltd.) were used (volume-average particle diameter=8.0 μm).

e-4:

Products obtained by classifying NICABEADS PC-0520 (trade name; Nippon Carbon Co., Ltd.) were used (volume-average particle diameter=3.7 μm).

e-5:

Products obtained by classifying NICABEADS PC-1020 (trade name; Nippon Carbon Co., Ltd.) were used (volume-average particle diameter=8.5 μm).

<Carbon Black>

A TOKABLACK #5500 (trade name, manufactured by TOKAI CARBON CO., LTD.) was used as carbon black.

<Quaternary Ammonium Salt>

Any one of the following compounds was used as a quaternary ammonium salt.

f-1:

Exemplary Compound 1 in Table I was used.

f-2:

Exemplary Compound 2 in Table I was used.

<Binder Resin>

Any one of the following products was used as a binder resin.

l-1:

A solution containing 40% of methanol of resole-type phenol resin (trade name: J-325; manufactured by Dainippon Ink and Chemicals, Incorporated.) synthesized by using an ammonia catalyst was used.

l-2:

A resole-type phenol resin (trade name: GF 9000; manufactured by Dainippon Ink and Chemicals, Incorporated.) synthesized by using an NaOH catalyst was used.

l-3:

A product obtained by blending polyol (trade name: NIPPOLAN 5037; manufactured by NIPPON POLYURETHANE INDUSTRY CO. LTD.) and a curing agent (trade name: Colonate L; manufactured by NIPPON POLYURETHANE INDUSTRY CO. LTD.) in the ratio of 10:1 was used.

(3) Examples

Example 1

<Production of Developer Bearing Member g-1>

A developer bearing member g-1 to be combined with the developer c-1 prepared in advance was produced by the following method. First, the following materials were mixed, and the mixture was treated with a horizontal sand mill (filled with glass beads having a diameter of 0.6 mm in the packing ratio of 85%), whereby a primary dispersion liquid h-1 was obtained.

| | |
|---|---|
| Binder resin l-1 | 166.7 parts by mass (solid content 100 parts by mass) |
| Graphitized particles b-1 | 90 parts by mass |
| Carbon black | 10 parts by mass |
| Methanol | 133.3 parts by mass |

Next, the following materials were mixed, and the mixture was treated with a vertical sand mill (filled with glass beads having a diameter of 0.8 mm in the packing ratio of 50%), whereby a secondary dispersion liquid i-1 was obtained. Further, the dispersion liquid was diluted with methanol, whereby a coating liquid j-1 having a solid content of 37% was obtained.

| | |
|---|---|
| Primary dispersion liquid h-1 | 400 parts by mass (solid content 200 parts by mass) |
| Binder resin l-1 | 250 parts by mass (solid content 150 parts by mass) |
| Quaternary ammonium salt f-1 | 62.5 parts by mass |
| Conductive, spherical carbon particles | 95 parts by mass |
| Methanol | 250 parts by mass |

A cylindrical tube made of aluminum (Ra=0.3 μm; reference length (lr)=4 mm) having a length of 320 mm and an external diameter of 24.5 mm was prepared as a substrate. After both end portions of the substrate having a length of 6 mm was masked, the substrate was placed so that its axis was parallel to a vertical line. Then, the substrate was rotated at 1,200 rpm, and the coating liquid was applied to the substrate while an air spray gun (trade name: GP 05-23; manufactured by MESAC CO., LTD.) was lowered at 30 mm/sec. Thus, an coating film was formed so as to have a thickness of 12 μm after curing. Subsequently, the coating film was heated in a hot-air drying furnace at 150° C. for 30 minutes to be cured, whereby a developer bearing member intermediate k-1 was produced. Next, the surface of the developer bearing member intermediate k-1 was subjected to polishing with the apparatus shown in FIG. 5. A tape-like abrasive (trade name: Wrapping Film Sheet #3000; manufactured by Sumitomo 3M Limited) having a width of 5 cm was used as an abrasive. Then, the polishing was performed at a tape take-up rate of 15 mm/sec, a feed rate of the abrasive of 30 mm/sec in the axial direction of a sleeve, a load of 0.2 N at which the abrasive was pressed against the developer bearing member intermediate k-1, and the number of revolutions of the developer bearing member intermediate k-1 of 1,000 rpm. Then, the developer bearing member g-1 having a specific surface shape shown in Table 6 was obtained. The above tape-like abrasive used aluminum oxide particles having an average primary particle diameter of 5 μm as abrasive particles.

<Formation of Electrophotographic Image-Forming Apparatus and Image Evaluation Using it>

A magnet roller was inserted into the resultant developer bearing member g-1, and flanges were attached to both ends of the carrier. The resultant was mounted as the developing roller of a developing apparatus of an electrophotographic image-forming apparatus (trade name: iR6010; manufactured by Canon Inc.). A gap between a magnetic doctor blade and the developer bearing member g-1 was set to 250 μm.

In addition, the developer c-1 was charged as a developer into the above electrophotographic image-forming apparatus, and the following image evaluation was performed. That is, an image output test was performed by continuously printing character images each having a print percentage of 5% on 5,000 sheets of A4-size paper in a cross-feed mode, a one hour pause was taken, and an image output test was performed by continuously printing such images on 1,000 sheets after the pause. After that, an image output test was performed by continuously printing such images on up to 495,000 sheets while pauses were temporarily taken during replenishment with the developer or paper. Further, an image output test was performed by continuously printing such images on up to 500,000 sheets, a one hour pause was taken, and an image output test was performed by continuously printing such images on 1,000 sheets after the pause. The image evaluation was performed for the following items: initial image density, initial image quality, the difference between a density before a pause and that after the pause at the time of printing 5,000 sheets, density recovery after the pause at the time of printing 5,000 sheets, the difference in density between before and after a pause at the time of printing 500,000 sheets, density recovery after a pause at the time of printing 500,000 sheets, and the difference between image density at the time of printing 5,000 sheets and image density at the time of printing 500,000 sheets. The image evaluation was performed by the following evaluation method on the basis of the following evaluation criteria. The image evaluation was performed in a normal-temperature, normal-humidity environment (23° C., 50% RH; N/N). It should be noted that A4-size office planner paper (manufactured by Canon Marketing Japan Inc.; 64 g/m$^2$) was used in the image evaluation. Table 7 shows the results.

(1) Initial Image Density

A solid image was output at the initial stage of an image output test, and its density was measured at five points. The density is relative density to the white background whose density is 0.00. The average of the measured values was defined as image density. Base on the measurement result, evaluation was made according to the following criteria. The image density was measured with "Macbeth reflection densitometer RD918" (manufactured by Macbeth Co.).

A: 1.40 or more
B: 1.30 or more and less than 1.40
C: 1.00 or more and less than 1.30
D: Less than 1.00

(2) Initial Image Quality

Figure 9:
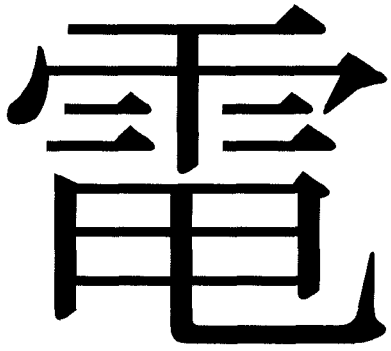
FIG. 9 is an explanatory view for an image used in evaluation for initial image quality in each example.

A Chinese character image shown in FIG. 9 whose size was four points was output at the initial stage of an image output test, and was evaluated for image quality on the basis of the following criteria by visually observing image density thinning or scattering.

A: The image is a vivid image free of scattering even when observed with a loupe having a magnification of 10.
B: The image is a vivid image when visually observed.
C: The image shows slight scattering, but can be put into practical use without any problem.
D: Image density thinning as well as scattering is remarkable.

(3) Difference in density between before after pause at time of printing 5,000 sheets A solid image was output at the time of printing 5,000 sheets in an image output test, and its image density was measured in the same manner as in the evaluation for the above item (1). After the solid image at the time of printing 5,000 sheets had been output, the copying machine was allowed to take a pause for 1 hour while its power source was turned on. A solid image was output after the pause, and its image density was measured in the same manner as in the evaluation for the above item (1). Evaluation was performed by ranking the difference between the image density at the time of printing 5,000 sheets and the image density after the pause on the basis of the following criteria.

A: The density difference is less than 0.10.
B: The density difference is 0.10 or more and less than 0.15.
C: The density difference is 0.15 or more and less than 0.20.
D: The density difference is 0.20 or more.

(4) Density Recovery after Rest at Time of Printing 5,000 Sheets

In an image output test, solid images were further output on 1,000 sheets after the image output test of the above item (3), and their image densities were measured in the same manner as in the evaluation for the above item (1). The number of sheets at which the different in image density between before and after a pause came to be 0.05 or less was defined as the time point when the image density recovered, and evaluation was performed by ranking the number on the basis of the following criteria.

A: The number of sheets at which the image density recovers is 10 or less.
B: The number of sheets at which the image density recovers is more than 10 and 100 or less.
C: The number of sheets at which the image density recovers is more than 100 and 500 or less.
D: The number of sheets at which the image density recovers is more than 500 and 1,000 or less.
E: The image density does not recover even when the 1,000 sheets have been printed.

(5) Difference in Density Between Before and After Pause at Time of Printing 500,000 Sheets In an image output test, evaluation was performed by ranking the difference in density between before and after a pause at the time of printing 500,000 sheets on the basis of the following criteria in the same manner as in the above item (3).

A: The density difference is less than 0.10.
B: The density difference is 0.10 or more and less than 0.15.
C: The density difference is 0.15 or more and less than 0.20.
D: The density difference is 0.20 or more.

(6) Density Recovery after Rest at Time of Printing Sheets

In an image output test, evaluation was performed by ranking density recovery after a pause at the time of printing 500,000 sheets on the basis of the following criteria in the same manner as in the above item (4).

A: The number of sheets at which the image density recovers is 10 or less.
B: The number of sheets at which the image density recovers is more than 10 and 100 or less.
C: The number of sheets at which the image density recovers is more than 100 and 500 or less.
D: The number of sheets at which the image density recovers is more than 500 and 1,000 or less.
E: The image density does not recover even when the 1,000 sheets have been printed.

(7) Difference Between Density at Time of Printing 10,000 Sheets and Density at Time of Printing 500,000 Sheets In an Image Output Test, Evaluation was Performed by ranking the difference between image density before a pause at the time of printing 10,000 sheets and image density before a pause at the time of printing 500,000 sheets on the basis of the following criteria.

A: The density difference is less than 0.10.
B: The density difference is 0.10 or more and less than 0.15.
C: The density difference is 0.15 or more and less than 0.20.
D: The density difference is 0.20 or more.

Examples 2 to 8

A developer to be combined with the above developer bearing member g-1 was changed as shown in Table 6. Table 6 shows various numerical values representing the surface shape of the developer bearing member g-1 in relation to each developer. In addition, image evaluation was performed in the same manner as in Example 1 except that an electrophotographic image-forming apparatus according to each combination was used. Table 7 shows the results.

Example 9

A developer bearing member g-2 to be combined with the developer c-1 was produced as described below. In other words, the developer bearing member g-2 was produced in the same manner as in the developer bearing member g-1except that the graphitized particles d-1 used in the production of the above-mentioned developer bearing member g-1 were changed to the graphitized particles d-2. Table 6 shows various numerical values representing the surface shape of the developer bearing member g-2 in relation to the developer c-1. In addition, image evaluation was performed in the same manner as in Example 1 except that an electrophotographic image-forming apparatus in which the developer c-1 and the developer bearing member g-2 were combined with each other was used. Table 7 shows the results.

Example 10

A developer bearing member d-3 to be combined with the developer c-1 was produced as described below. In other words, the developer bearing member d-3 was produced in the same manner as in the developer bearing member g-1 except that the graphitized particles d-1 used in the production of the above-mentioned developer bearing member g-1 were changed to the graphitized particles d-3. Table 6 shows various numerical values representing the surface shape of the developer bearing member d-3 in relation to the developer c-1. In addition, image evaluation was performed in the same manner as in Example 1 except that an electrophotographic image-forming apparatus in which the developer c-1 and the developer bearing member d-3 were combined with each other was used. Table 7 shows the results.

Example 11

A developer bearing member d-9 to be combined with the developer c-1 was produced as described below. In other words, the developer bearing member d-9 was produced in the same manner as in the developer bearing member g-1 except that a tape-like abrasive (trade name: Wrapping Film Sheet #4000; manufactured by Sumitomo 3M Limited) having an average primary particle diameter of 3 μm was used as a tape-like abrasive. Table 6 shows various numerical values representing the surface shape of the developer bearing member d-9 in relation to the developer c-1. In addition, image evaluation was performed in the same manner as in Example 1 except that an electrophotographic image-forming apparatus in which the developer c-1 and the developer bearing member d-9 were combined with each other was used. Table 7 shows the results.

Example 12

A developer bearing member d-10 to be combined with the developer c-1 was produced as described below. In other words, the developer bearing member d-10 was produced in the same manner as in the developer bearing member g-1 except that a tape-like abrasive (trade name: Wrapping Film Sheet #2000; manufactured by Sumitomo 3M Limited) having an average primary particle diameter of 9 μm was used as a tape-like abrasive. Table 6 shows various numerical values representing the surface shape of the developer bearing member d-10 in relation to the developer c-1. In addition, image evaluation was performed in the same manner as in Example 1 except that an electrophotographic image-forming apparatus in which the developer c-1 and the developer bearing member d-10 were combined with each other was used. Table 7 shows the results.

Example 13

A developer bearing member g-12 to be combined with the developer c-1 was produced as described below. In other words, the developer bearing member g-12 was produced in the same manner as in the developer bearing member g-1 except that the conductive, spherical carbon particles e-1 used in the production of the above-mentioned developer bearing member g-1 were changed to 120 parts by mass of the conductive, spherical carbon particles e-2. Table 6 shows various numerical values representing the surface shape of the developer bearing member g-12 in relation to the developer c-1. In addition, image evaluation was performed in the same manner as in Example 1 except that an electrophotographic image-forming apparatus in which the developer c-1 and the developer bearing member g-12 were combined with each other was used. Table 7 shows the results.

Example 14

A developer bearing member g-11 to be combined with the developer c-1 was produced as described below. In other words, the developer bearing member g-11 was produced in the same manner as in the developer bearing member g-1except that the conductive, spherical carbon particles e-1 used in the production of the above-mentioned developer bearing member g-1 were changed to 70 parts by mass of the conductive, spherical carbon particles e-3. Table 6 shows various numerical values representing the surface shape of the developer bearing member g-11 in relation to the developer c-1. In addition, image evaluation was performed in the same manner as in Example 1 except that an electrophotographic image-forming apparatus in which the developer c-1 and the developer bearing member g-11 were combined with each other was used. Table 7 shows the results.

Example 15

A developer bearing member g-22 to be combined with the developer c-1 was produced as described below. In other words, the developer bearing member g-22 was produced in the same manner as in the developer bearing member g-1 except that: the quaternary ammonium salt f-1 used in the production of the above-mentioned developer bearing member g-1 was changed to the quaternary ammonium salt f-2; the conductive, spherical carbon particles e-1 were changed to 30 parts by mass of the conductive, spherical carbon particles e-2; and a tape-like abrasive (trade name: Wrapping Film Sheet #4000; manufactured by Sumitomo 3M Limited) having an average primary particle diameter of 3 μm was used as a tape-like abrasive. Table 6 shows various numerical values representing the surface shape of the developer bearing member g-22 in relation to the developer c-1. In addition, image evaluation was performed in the same manner as in Example 1 except that an electrophotographic image-forming apparatus in which the developer c-1 and the developer bearing member g-22 were combined with each other was used. Table 7 shows the results.

Example 16

A developer bearing member g-23 to be combined with the developer c-1 was produced as described below. In other words, the developer bearing member g-23 was produced in the same manner as in the developer bearing member g-22 except that: 125 parts by mass of the conductive, spherical carbon particles e-3 were used instead of the conductive, spherical carbon particles e-2 used in the production of the developer bearing member g-22; and a tape-like abrasive (trade name: Wrapping Film Sheet #2000; manufactured by Sumitomo 3M Limited) having an average primary particle diameter of 9 μm was used as a tape-like abrasive. Table 6 shows various numerical values representing the surface shape of the developer bearing member g-23 in relation to the developer c-1. In addition, image evaluation was performed in the same manner as in Example 1 except that an electrophotographic image-forming apparatus in which the developer c-1 and the developer bearing member g-23 were combined with each other was used. Table 7 shows the results.

Example 17

A developer bearing member g-15 to be combined with the developer c-1 was produced as described below. In other words, the developer bearing member g-15 was produced in the same manner as in the developer bearing member g-1 except that: the amount of the quaternary ammonium salt f-1 used in the production of the developer bearing member g-1 was changed to 12.5 parts by mass; and the amount of the conductive, spherical carbon particles e-1 used in the production was changed to 80 parts by mass. Table 6 shows various numerical values representing the surface shape of the developer bearing member g-15 in relation to the developer c-1. In addition, image evaluation was performed in the same manner as in Example 1 except that an electrophotographic image-forming apparatus in which the developer c-1 and the developer bearing member g-15 were combined with each other was used. Table 7 shows the results.

Example 18

A developer bearing member g-16 to be combined with the developer c-1 was produced as described below. In other words, the developer bearing member g-16 was produced in the same manner as in the developer bearing member g-1 except that: the amount of the quaternary ammonium salt f-1 used in the production of the developer bearing member g-1 was changed to 125 parts by mass; and the amount of the conductive, spherical carbon particles e-1 used in the production was changed to 115 parts by mass. Table 6 shows various numerical values representing the surface shape of the developer bearing member g-16 in relation to the developer c-1. In addition, image evaluation was performed in the same manner as in Example 1 except that an electrophotographic image-forming apparatus in which the developer c-1 and the developer bearing member g-16 were combined with each other was used. Table 7 shows the results.

Examples 19 to 22

A developer to be combined with the developer bearing member g-1 was changed as shown in Table 6. Table 6 shows various numerical values representing the surface shape of the developer bearing member g-1 in relation to each developer. In addition, image evaluation was performed in the same manner as in Example 1 except that an electrophotographic image-forming apparatus according to each combination was used. Table 7 shows the results.

Example 23

A developer bearing member g-24 to be combined with the developer c-1 was produced as described below. In other words, the developer bearing member g-24 was produced in the same manner as in the developer bearing member g-1 except that the binder resin I-1 used in the production of the developer bearing member g-1 was changed to the binder resin I-3. Table 6 shows various numerical values representing the surface shape of the developer bearing member g-24 in relation to the developer c-1. In addition, image evaluation was performed in the same manner as in Example 1 except that an electrophotographic image-forming apparatus in which the developer c-1 and the developer bearing member g-24 were combined with each other was used. Table 7 shows the results.

Example 24

A developer bearing member g-21 to be combined with the developer c-3 was produced as described below. In other words, the developer bearing member g-21 was produced in the same manner as in the developer bearing member g-1 except that: 25 parts by mass of the conductive, spherical carbon particles e-2 were used instead of the conductive, spherical carbon particles e-1 used in the production of the developer bearing member g-1; and a tape-like abrasive (trade name: Wrapping Film Sheet #2000; manufactured by Sumitomo 3M Limited) having an average primary particle diameter of 9 μm was used as a tape-like abrasive. Table 6 shows various numerical values representing the surface shape of the developer bearing member g-21 in relation to the developer c-3. In addition, image evaluation was performed in the same manner as in Example 1 except that an electrophotographic image-forming apparatus in which the developer c-3 and the developer bearing member g-21 were combined with each other was used. Table 7 shows the results.

Example 25

A developer bearing member g-20 to be combined with the developer c-3 was produced as described below. In other words, the developer bearing member g-20 was produced in the same manner as in the developer bearing member g-1 except that 30 parts by mass of the conductive, spherical carbon particles e-2 were used instead of the conductive, spherical carbon particles e-1 used in the production of the developer bearing member g-1. Table 6 shows various numerical values representing the surface shape of the developer bearing member g-20 in relation to the developer c-3. In addition, image evaluation was performed in the same manner as in Example 1 except that an electrophotographic image-forming apparatus in which the developer c-3 and the developer bearing member g-20 were combined with each other was used. Table 7 shows the results.

Example 26

A developer bearing member g-18 to be combined with the developer c-2 was produced as described below. In other words, the developer bearing member g-18 was produced in the same manner as in the developer bearing member g-1 except that: 125 parts by mass of the conductive, spherical carbon particles e-3 were used instead of the conductive, spherical carbon particles e-1 used in the production of the developer bearing member g-1; and a tape-like abrasive (trade name: Wrapping Film Sheet #4000; manufactured by Sumitomo 3M Limited) having an average primary particle diameter of 3 μm was used as a tape-like abrasive. Table 6 shows various numerical values representing the surface shape of the developer bearing member g-18 in relation to the developer c-2. In addition, image evaluation was performed in the same manner as in Example 1 except that an electrophotographic image-forming apparatus in which the developer c-2 and the developer bearing member g-18 were combined with each other was used. Table 7 shows the results.

Example 27

A developer bearing member g-19 to be combined with the developer c-2 was produced as described below. In other words, the developer bearing member g-19 was produced in the same manner as in the developer bearing member g-18 except that the amount of the conductive, spherical carbon particles e-3 used in the production of the developer bearing member g-18 according to Example 26 described above was changed to 150 parts by mass. Table 6 shows various numerical values representing the surface shape of the developer bearing member g-19 in relation to the developer c-2. In addition, image evaluation was performed in the same manner as in Example 1 except that an electrophotographic image-forming apparatus in which the developer c-2 and the developer bearing member g-19 were combined with each other was used. Table 7 shows the results.

Example 28

A developer bearing member g-6 to be combined with the developer c-1 was produced as described below. In other words, the developer bearing member g-6 was produced in the same manner as in the developer bearing member g-1 except that: the graphitized particles d-1 used in the production of the developer bearing member g-1 were changed to the graphitized particles d-4; and the quaternary ammonium salt f-1 used in the production was changed to the quaternary ammonium salt f-2. Table 6 shows various numerical values representing the surface shape of the developer bearing member g-6 in relation to the developer c-1. In addition, image evaluation was performed in the same manner as in Example 1 except that an electrophotographic image-forming apparatus in which the developer c-1 and the developer bearing member g-6 were combined with each other was used. Table 7 shows the results.

Example 29

A developer bearing member g-7 to be combined with the developer c-1 was produced as described below. In other words, the developer bearing member g-7 was produced in the same manner as in the developer bearing member g-1 except that: the graphitized particles d-1 used in the production of the developer bearing member g-1 were changed to the graphitized particles d-5; and the quaternary ammonium salt f-1 used in the production was changed to the quaternary ammonium salt f-2. Table 6 shows various numerical values representing the surface shape of the developer bearing member g-7 in relation to the developer c-1. In addition, image evaluation was performed in the same manner as in Example 1 except that an electrophotographic image-forming apparatus in which the developer c-1 and the developer bearing member g-7 were combined with each other was used. Table 7 shows the results.

Comparative Examples 1 to 5

A developer to be combined with the developer bearing member g-1 was changed as shown in Table 8. Table 9 shows various numerical values representing the surface shape of the developer bearing member g-1 in relation to each developer. In addition, image evaluation was performed in the same manner as in Example 1 except that an electrophotographic image-forming apparatus according to each combination was used. Table 9 shows the results.

Comparative Example 6

A developer bearing member g-4 was produced in the same manner as in the developer bearing member g-1 except that the graphitized particles d-1 used in the production of the developer bearing member g-1 were changed to the graphitized particles d-6. Table 8 shows various numerical values representing the surface shape of the developer bearing member g-4 in relation to the developer c-1. In addition, image evaluation was performed in the same manner as in Example 1 except that an electrophotographic image-forming apparatus in which the developer c-1 and the developer bearing member g-4 were combined with each other was used. Table 9 shows the results.

Comparative Example 7

A developer bearing member g-5 was produced in the same manner as in the developer bearing member g-1 except that the graphitized particles d-1 used in the production of the developer bearing member g-1 were changed to the graphitized particles d-7. Table 8 shows various numerical values representing the surface shape of the developer bearing member g-5 in relation to the developer c-1. In addition, image evaluation was performed in the same manner as in Example 1 except that an electrophotographic image-forming apparatus in which the developer c-1 and the developer bearing member g-5 were combined with each other was used. Table 9 shows the results.

Comparative Example 8

The developer bearing member g-6 according to Example 28 and the developer c-3 were combined with each other. Table 8 shows various numerical values representing the surface shape of the developer bearing member g-6 in relation to the developer c-3. In addition, image evaluation was performed in the same manner as in Example 1 except that an electrophotographic image-forming apparatus in which the developer c-3 and the developer bearing member g-6 were combined with each other was used. Table 9 shows the results.

Comparative Example 9

The developer bearing member d-10 according to Example 12 and the developer c-2 were combined with each other. Table 8 shows various numerical values representing the surface shape of the developer bearing member d-10 in relation to the developer c-2. In addition, image evaluation was performed in the same manner as in Example 1 except that an electrophotographic image-forming apparatus in which the developer c-2 and the developer bearing member g-10 were combined with each other was used. Table 9 shows the results.

Comparative Example 10

A developer bearing member g-13 was produced in the same manner as in the developer bearing member g-1 except that 125 parts by mass of the conductive, spherical carbon particles e-4 were used instead of the conductive, spherical carbon particles e-1 used in the production of the developer bearing member g-1. Table 8 shows various numerical values representing the surface shape of the developer bearing member g-13 in relation to the developer c-2. In addition, image evaluation was performed in the same manner as in Example 1 except that an electrophotographic image-forming apparatus in which the developer c-2 and the developer bearing member g-13 were combined with each other was used. Table 9 shows the results.

Comparative Example 11

A-developer bearing member g-14 was produced in the same manner as in the developer bearing member g-1 except that 65 parts by mass of the conductive, spherical carbon particles e-5 were used instead of the conductive, spherical carbon particles e-1 used in the production of the developer bearing member g-1. Table 8 shows various numerical values representing the surface shape of the developer bearing member g-14 in relation to the developer c-3. In addition, image evaluation was performed in the same manner as in Example 1 except that an electrophotographic image-forming apparatus in which the developer c-3 and the developer bearing member g-14 were combined with each other was used. Table 9 shows the results.

Comparative Example 12

The developer bearing member g-22 according to Example 15 and the developer c-3 were combined with each other.

Table 8 shows various numerical values representing the surface shape of the developer bearing member g-22 in relation to the developer c-3. In addition, image evaluation was performed in the same manner as in Example 1 except that an electrophotographic image-forming apparatus in which the developer c-3 and the developer bearing member g-22 were combined with each other was used. Table 9 shows the results.

Comparative Example 13

The developer bearing member g-23 according to Example 16 and the developer c-2 were combined with each other. Table 8 shows various numerical values representing the surface shape of the developer bearing member g-23 in relation to the developer c-2. In addition, image evaluation was performed in the same manner as in Example 1 except that an electrophotographic image-forming apparatus in which the developer c-2 and the developer bearing member g-23 were combined with each other was used. Table 9 shows the results.

Comparative Example 14

A developer bearing member g-17 was produced in the same manner as in the developer bearing member g-1 except that: the quaternary ammonium salt used in the production of the developer bearing member g-1 was not used; and the conductive, spherical carbon particles e-1 was used in the amount of 80 parts by mass. Table 8 shows various numerical values representing the surface shape of the developer bearing member g-17 in relation to the developer c-1. In addition, image evaluation was performed in the same manner as in Example 1 except that an electrophotographic image-forming apparatus in which the developer c-1 and the developer bearing member g-17 were combined with each other was used. Table 9 shows the results.

Comparative Example 15

A developer bearing member g-25 was produced in the same manner as in the developer bearing member g-1 except that the binder resin I-1 used in the production of the developer bearing member g-1 was changed to the binder resin I-2. Table 8 shows various numerical values representing the surface shape of the developer bearing member g-25 in relation to the developer c-1. In addition, image evaluation was performed in the same manner as in Example 1 except that an electrophotographic image-forming apparatus in which the developer c-1 and the developer bearing member g-25 were combined with each other was used. Table 9 shows the results.

In addition, Table 10 shows the Ra(Total) of each of the developer bearing members g-1 to g-7 and d-9 to g-25 used in the Examples and Comparative Examples described above, the arithmetic average particle diameter (Dn) of the graphitized particles used in the Examples and Comparative Examples, and the universal hardness (HU) of the respective developer bearing members.

TABLE 6

| | Developer | Developer bearing member | Ra(A) (μm) | Ra(B) (μm) | Number of protrusions having height in excess of H + (4/4) in unit area (Number) | Ratio of total sum of areas of protrusions having height in excess of H + (D4/4) at height of H + (D4/4) to unit area (%) |
|---|---|---|---|---|---|---|
| Example 1 | c-1 | g-1 | 0.38 | 0.84 | 18 | 14 |
| Example 2 | c-8 | g-1 | 0.45 | 0.75 | 19 | 22.6 |
| Example 3 | c-9 | g-1 | 0.36 | 0.93 | 15 | 6.6 |
| Example 4 | c-4 | g-1 | 0.38 | 0.83 | 18 | 12.8 |
| Example 5 | c-5 | g-1 | 0.39 | 0.84 | 19 | 16 |
| Example 6 | c-7 | g-1 | 0.4 | 0.85 | 19 | 16.4 |
| Example 7 | c-2 | g-1 | 0.45 | 0.76 | 21 | 22.8 |
| Example 8 | c-3 | g-1 | 0.35 | 0.94 | 16 | 6.2 |
| Example 9 | c-1 | g-2 | 0.38 | 0.87 | 18 | 13.8 |
| Example 10 | c-1 | g-3 | 0.37 | 0.85 | 17 | 13.8 |
| Example 11 | c-1 | g-9 | 0.32 | 0.88 | 9 | 5.12 |
| Example 12 | c-1 | g-10 | 0.48 | 0.79 | 11 | 29.2 |
| Example 13 | c-1 | g-12 | 0.37 | 0.68 | 17 | 23.2 |
| Example 14 | c-1 | g-11 | 0.38 | 1.18 | 14 | 11.2 |
| Example 15 | c-1 | g-22 | 0.25 | 0.65 | 15 | 13.6 |
| Example 16 | c-1 | g-23 | 0.54 | 0.95 | 18 | 20.0 |
| Example 17 | c-1 | g-15 | 0.37 | 0.8 | 19 | 16.8 |
| Example 18 | c-1 | g-16 | 0.39 | 0.9 | 18 | 15.2 |
| Example 19 | c-6 | g-1 | 0.4 | 0.85 | 17 | 16.8 |
| Example 20 | c-10 | g-1 | 0.39 | 0.83 | 18 | 15.6 |
| Example 21 | c-11 | g-1 | 0.39 | 0.84 | 17 | 14.4 |
| Example 22 | c-12 | g-1 | 0.38 | 0.84 | 17 | 14.4 |
| Example 23 | c-1 | g-24 | 0.041 | 0.072 | 18 | 20.8 |
| Example 24 | c-3 | g-21 | 0.35 | 0.73 | 10 | 9.48 |
| Example 25 | c-3 | g-20 | 0.34 | 0.74 | 8 | 8.96 |
| Example 26 | c-2 | g-18 | 0.43 | 0.91 | 13 | 26.8 |
| Example 27 | c-2 | g-19 | 0.44 | 0.95 | 14 | 28.0 |
| Example 28 | c-1 | g-6 | 0.39 | 0.97 | 17 | 13.2 |
| Example 29 | c-1 | g-7 | 0.38 | 0.78 | 18 | 15.2 |

TABLE 7

| | Initial | | At time of printing 5,000 sheets | | At time of printing 500,000 sheets | | Difference in density between at time of printing 5,000 sheets and at time of printing 500,000 sheets |
|---|---|---|---|---|---|---|---|
| | Density | Scattering | Density difference | Recovery | Density difference | Recovery | |
| Example 1 | A | A | A | A | A | A | A |
| Example 2 | A | C | B | B | B | B | B |
| Example 3 | C | C | A | B | B | B | B |
| Example 4 | B | B | A | A | B | A | A |
| Example 5 | B | B | A | A | B | B | A |
| Example 6 | A | A | A | A | B | B | B |
| Example 7 | B | B | B | A | B | A | B |
| Example 8 | B | B | A | B | B | B | B |
| Example 9 | B | A | A | B | B | B | B |
| Example 10 | B | B | B | C | B | C | A |
| Example 11 | B | A | A | B | B | B | B |
| Example 12 | A | A | B | A | B | B | B |
| Example 13 | B | A | B | A | B | B | A |
| Example 14 | A | A | A | B | B | B | B |
| Example 15 | A | A | B | B | B | B | C |
| Example 16 | B | A | A | B | B | B | B |
| Example 17 | A | A | B | B | B | B | B |
| Example 18 | C | B | A | A | A | B | A |
| Example 19 | B | A | B | C | B | C | B |
| Example 20 | B | A | B | B | B | B | B |
| Example 21 | B | A | A | B | B | B | B |
| Example 22 | C | A | A | B | B | C | B |
| Example 23 | B | B | B | B | B | B | D |
| Example 24 | C | B | B | A | B | B | B |
| Example 25 | B | B | B | B | B | B | B |
| Example 26 | B | B | B | B | B | B | B |
| Example 27 | B | B | B | C | B | C | C |
| Example 28 | C | A | B | B | B | C | B |
| Example 29 | B | A | B | C | B | C | B |

TABLE 8

| | Developer | Developer bearing member | Ra(A) (μm) | Ra(B) (μm) | Number of protrusions each having height in excess of H + ($D_4$/4) in unit area (Number) | Ratio of total sum of areas of protrusions each having height in excess of H + ($D_4$/4) at height of H + ($D_4$/4) to unit area (%) |
|---|---|---|---|---|---|---|
| Comparative Example 1 | c-13 | g-1 | 0.4 | 0.84 | 19 | 16 |
| Comparative Example 2 | c-14 | g-1 | 0.38 | 0.84 | 16 | 12.4 |
| Comparative Example 3 | c-15 | g-1 | 0.39 | 0.86 | 17 | 15.2 |
| Comparative Example 4 | c-16 | g-1 | 0.5 | 0.68 | 21 | 26 |
| Comparative Example 5 | c-17 | g-1 | 0.29 | 1.05 | 17 | 5.2 |
| Comparative Example 6 | c-1 | g-4 | 0.38 | 0.84 | 16 | 14 |
| Comparative Example 7 | c-1 | g-5 | 0.37 | 0.84 | 18 | 13.8 |
| Comparative Example 8 | c-3 | g-6 | 0.48 | 1.02 | 7 | 4.48 |
| Comparative Example 9 | c-2 | g-10 | 0.53 | 0.77 | 9 | 32.4 |
| Comparative Example 10 | c-2 | g-13 | 0.4 | 0.61 | 12 | 28.8 |
| Comparative Example 11 | c-3 | g-14 | 0.34 | 1.23 | 9 | 5.2 |
| Comparative Example 12 | c-3 | g-22 | 0.23 | 0.73 | 6 | 5.92 |
| Comparative Example 13 | c-2 | g-23 | 0.6 | 0.84 | 10 | 30.4 |
| Comparative Example 14 | c-1 | g-17 | 0.38 | 0.82 | 15 | 12.8 |
| Comparative Example 15 | c-1 | g-25 | 0.39 | 0.82 | 18 | 15.2 |

TABLE 9

| | Initial | | At time of printing 5,000 sheets | | At time of printing 500,000 sheets | | Difference in density between at time of printing 5,000 sheets and at time of printing 500,000 sheets |
|---|---|---|---|---|---|---|---|
| | Density | Scattering | Density difference | Recovery | Density difference | Recovery | |
| Comparative Example 1 | D | D | C | E | D | E | B |
| Comparative Example 2 | D | C | D | D | D | E | B |
| Comparative Example 3 | B | B | C | D | D | D | B |
| Comparative Example 4 | B | C | D | D | D | E | C |
| Comparative Example 5 | D | C | C | E | D | E | B |
| Comparative Example 6 | C | A | B | B | C | E | D |
| Comparative Example 7 | B | B | B | E | B | E | A |
| Comparative Example 8 | D | A | C | E | C | E | B |
| Comparative Example 9 | A | A | D | B | D | B | B |
| Comparative Example 10 | D | A | C | E | D | E | C |
| Comparative Example 11 | C | A | D | E | D | E | B |
| Comparative Example 12 | A | B | D | D | D | E | D |
| Comparative Example 13 | B | B | B | E | C | E | C |
| Comparative Example 14 | A | B | D | D | D | E | B |
| Comparative Example 15 | B | D | D | E | D | E | C |

TABLE 10

| Developer bearing member | Ra(Total) (μm) | Arithmetic average particle diameter (Dn) of graphitized particles (μm) | Universal hardness ($N/mm^2$) |
|---|---|---|---|
| g-1 | 1.03 | 1.9 | 553 |
| g-2 | 1.10 | 2.9 | 568 |
| g-3 | 1.08 | 2.4 | 545 |
| g-4 | 1.02 | 1.9 | 520 |
| g-5 | 1.05 | 2.2 | 528 |
| g-6 | 1.17 | 3.4 | 582 |
| g-7 | 0.93 | 0.5 | 480 |
| g-9 | 1.08 | 1.9 | 558 |
| g-10 | 1.01 | 1.9 | 551 |
| g-11 | 1.10 | 2.0 | 608 |
| g-12 | 0.99 | 1.9 | 500 |
| g-13 | 0.98 | 2.1 | 489 |
| g-14 | 1.08 | 2.0 | 630 |
| g-15 | 0.98 | 2.0 | 523 |
| g-16 | 1.15 | 2.0 | 571 |
| g-17 | 1.10 | 1.8 | 506 |
| g-18 | 1.39 | 2.0 | 689 |
| g-19 | 1.51 | 1.9 | 702 |
| g-20 | 0.62 | 1.9 | 385 |
| g-21 | 0.55 | 2.0 | 352 |
| g-22 | 0.65 | 1.9 | 386 |
| g-23 | 1.31 | 2.0 | 684 |
| g-24 | 1.01 | 1.9 | 41 |
| g-25 | 1.04 | 1.9 | 555 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-037419, filed Feb. 19, 2008, which is hereby incorporated by reference herein in its entirety.

What is claimed is:

1. A developing apparatus comprising at least:

a developer for developing an electrostatic latent image formed on a photosensitive drum;

a developer bearing member for bearing and conveying the developer; and a developer layer thickness-regulating unit placed close to the developer bearing member so as to regulate an amount of the developer borne and conveyed by the developer bearing member, wherein:

the developer is a negatively chargeable, one-component, magnetic toner, and comprises a magnetic toner particle comprising at least a binder resin and a magnetic iron oxide particle, the developer has a saturation magnetization of 20 $Am^2/kg$ or more and 40 $Am^2/kg$ or less in a magnetic field of 795.8 kA/m, and has a weight-average particle diameter ($D_4$) of 4.0 μm or more and 8.0 μm or less, wherein a ratio X of an amount of Fe(2+) to a total amount of Fe is 34% or more and 50% or less, the total amount of Fe being an amount of Fe element when the magnetic iron oxide particle is dissolved so that an Fe element dissolution ratio reaches 10 mass %;

the developer bearing member comprises at least a substrate, a resin layer as a surface layer formed on the substrate, and a magnetic member which is provided in the substrate, wherein the resin layer triboelectrically charges the developer negatively, and contains a binder resin having in its structure at least one selected from the group consisting of a —$NH_2$ group, a =NH group, and a —NH— bond, a quaternary ammonium salt for reducing a negative triboelectric chargeability of the resin layer for the developer, a graphitized particle having a graphitization degree p(002) of 0.22 or more and 0.75 or less, and a conductive, spherical carbon particle having a volume-average particle diameter of 4.0 μm to 8.0 μm as a particle part for providing a surface of the resin layer with irregularities, wherein, when a square region of 0.50 mm in side on the surface of the developer bearing member is equally divided with 725 straight lines which are parallel to one side of the square region, and other 725 straight lines intersecting therewith at right angle, the whole area of the developer bearing member on which the developer is borne has a plurality of independent protrusions whose heights exceeds $D_4/4$ with reference to an average (H) of three-dimensional heights measured at intersections of the 725 straight liens and the other 725 straight lines, wherein the sum of areas of the protrusions at a height of $D_4/4$ is 5% or more and 30% or less of the region, arithmetic average roughness Ra(A) determined from areas only the protrusions is 0.25 μm or more and 0.55 μm or less, and arithmetic average roughness Ra(B) determined from areas other than the protrusions is 0.65 μm or more and 1.20 μm or less.

2. A developing apparatus according to claim 1, wherein a ratio (X/Y) of the magnetic iron oxide particle is larger than 1.00 and 1.30 or less, wherein Y represents a ratio of an amount of Fe(2+) to a total amount of Fe in remaining 90 mass % excluding the amount of Fe of which the magnetic iron oxide particle is dissolved so that the Fe element dissolution ratio reaches 10 mass %.

3. A developing apparatus according to claim 1, wherein the binder resin is a phenolic resin.

4. A developing apparatus according to claim 1, wherein, when a square region of 0.50 mm in side on the surface of the developer bearing member is equally divided with 725 straight lines which are parallel to one side of the square region, and other 725 straight lines intersecting therewith at right angle, the area of the developer bearing member on which the developer is borne has arithmetic average roughness Ra(Total) of 0.60 μm or more and 1.40 μm or less as determined from the three-dimensional heights measured at intersections of the 725 straight lines and the other 725 straight lines.

5. A developing apparatus according to claim 1, wherein:

an arithmetic average particle diameter (Dn) of the graphitized particle is 0.50 μm or more and 3.00 μm or less when a section of the resin layer is observed with an electron microscope; and an average (U) of universal hardnesses (HU) of the surface of the resin layer is 400 N/mm2 or more and 650 $N/mm^2$ or less.

6. A developing apparatus according to claim 1, wherein the resin layer is subjected to polishing with a strip-shaped abrasive bearing an abrasive particle on the surface thereof.

7. An electrophotographic image-forming apparatus comprising the developing apparatus according to claim 1.

* * * * *